US011328642B2

(12) United States Patent
Shang et al.

(10) Patent No.: US 11,328,642 B2
(45) Date of Patent: May 10, 2022

(54) GATE DRIVING UNIT, GATE DRIVING METHOD, GATE DRIVING CIRCUITRY AND DISPLAY DEVICE

(71) Applicant: BOE TECHNOLOGY GROUP CO., LTD., Beijing (CN)

(72) Inventors: Guangliang Shang, Beijing (CN); Lijun Yuan, Beijing (CN); Haoliang Zheng, Beijing (CN); Libin Liu, Beijing (CN); Xing Yao, Beijing (CN); Seungwoo Han, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/044,148

(22) PCT Filed: Mar. 18, 2020

(86) PCT No.: PCT/CN2020/079839
§ 371 (c)(1),
(2) Date: Sep. 30, 2020

(87) PCT Pub. No.: WO2020/207217
PCT Pub. Date: Oct. 15, 2020

(65) Prior Publication Data

US 2021/0166601 A1 Jun. 3, 2021

(30) Foreign Application Priority Data

Apr. 9, 2019 (CN) ..... 201910280077.1

(51) Int. Cl.
*G09G 3/20* (2006.01)

(52) U.S. Cl.
CPC ..... *G09G 3/20* (2013.01); *G09G 2300/0426* (2013.01); *G09G 2310/08* (2013.01)

(58) Field of Classification Search
CPC ..... G09G 3/20; G09G 2300/0426; G09G 2310/08; G09G 2310/0286; G09G 3/3266; G09G 3/3677
See application file for complete search history.

(56) References Cited

U.S. PATENT DOCUMENTS 5,982,703 A * 11/1999 Oh ..... G11C 8/10 365/230.06
5,990,857 A 11/1999 Kubota et al.
(Continued)

FOREIGN PATENT DOCUMENTS

CN 1506978 A 6/2004
CN 1702711 A 11/2005
(Continued)

OTHER PUBLICATIONS

First Office Action for Chinese Application No. 201910280077.1, dated Jan. 28, 2021, 7 Pages.
(Continued)

*Primary Examiner* — Grant Sitta
(74) *Attorney, Agent, or Firm* — Brooks Kushman P.C.

(57) ABSTRACT

The present disclosure provides a gate driving unit, a gate driving method, a gate driving circuitry and a display device. The gate driving unit includes a reverse-phase gate driving signal output end, a normal-phase gate driving signal output end, an input circuitry, an output control circuitry, an input node control circuitry and an output circuitry. The input circuitry is configured to control an input end to be electrically connected to an input node under the control of a first clock signal. The output control circuitry is configured to control a potential at an output node under the control of a potential at the input node and a second clock signal. The input node control circuitry is configured to control the potential at the input node in accordance with the potential at the output node under the control of the second clock
(Continued)

signal. The output circuitry is configured to output a reverse-phase gate driving signal and output a normal-phase gate driving signal in accordance with the potential at the output node.

20 Claims, 6 Drawing Sheets

(56) References Cited

U.S. PATENT DOCUMENTS

| | | | | |
|---|---|---|---|---|
| 6,919,875 | B2 * | 7/2005 | Abe | G09G 3/3266 326/46 |
| 7,782,121 | B2 * | 8/2010 | Jinta | H02M 3/07 327/536 |
| 8,872,736 | B2 * | 10/2014 | Shin | G09G 3/3233 345/76 |
| 10,262,609 | B2 * | 4/2019 | Dai | G09G 3/3648 |
| 11,227,562 | B2 * | 1/2022 | Huang | G11C 19/28 |
| 2006/0145964 | A1 | 7/2006 | Park et al. | |
| 2007/0040450 | A1 | 2/2007 | Chung | |
| 2008/0273004 | A1 * | 11/2008 | Osame | G09G 3/3275 345/100 |
| 2012/0133392 | A1 * | 5/2012 | Wang | G09G 3/3677 326/83 |
| 2014/0152629 | A1 * | 6/2014 | So | G09G 3/3266 345/205 |
| 2014/0159997 | A1 * | 6/2014 | Chen | G09G 3/3611 345/87 |
| 2014/0204011 | A1 * | 7/2014 | Hu | G09G 3/3655 345/100 |
| 2016/0351112 | A1 | 12/2016 | Qing et al. | |
| 2017/0039973 | A1 * | 2/2017 | Huang | G09G 3/3677 |
| 2017/0084238 | A1 * | 3/2017 | Cao | G09G 3/3266 |
| 2017/0162147 | A1 | 6/2017 | Kim | |
| 2017/0193946 | A1 * | 7/2017 | Huang | G11C 19/28 |
| 2017/0200408 | A1 * | 7/2017 | Zhang | G11C 19/28 |
| 2018/0158425 | A1 * | 6/2018 | Gong | G09G 3/3674 |
| 2018/0190178 | A1 * | 7/2018 | Hong | G09G 3/2092 |
| 2019/0004643 | A1 * | 1/2019 | Ma | G06F 3/04166 |
| 2019/0027102 | A1 * | 1/2019 | Hong | H03K 5/135 |
| 2019/0206504 | A1 | 7/2019 | Tao et al. | |
| 2019/0286178 | A1 * | 9/2019 | Wei | H03F 3/45188 |
| 2021/0097938 | A1 * | 4/2021 | Wu | G09G 3/3258 |

FOREIGN PATENT DOCUMENTS

| | | | |
|---|---|---|---|
| CN | 1801298 | A | 7/2006 |
| CN | 1917017 | A | 2/2007 |
| CN | 102708777 | A | 10/2012 |
| CN | 104269132 | A | 1/2015 |
| CN | 205282051 | U | 6/2016 |
| CN | 107958649 | A | 4/2018 |
| CN | 108735150 | A | 11/2018 |
| CN | 109872673 | A | 6/2019 |
| KR | 100931472 | B1 | 12/2009 |

OTHER PUBLICATIONS

International Search Report and Written Opinion for Application No. PCT/CN202020/079839, dated Jun. 22, 2020, 12 Pages.

* cited by examiner

GATE DRIVING UNIT, GATE DRIVING METHOD, GATE DRIVING CIRCUITRY AND DISPLAY DEVICE

CROSS-REFERENCE TO RELATED APPLICATIONS

This application is the U.S. national phase of PCT Application No. PCT/CN2020/079839 filed on Mar. 18, 2020, which claims priority to Chinese Patent Application No. 201910280077.1 filed on Apr. 9, 2019, which are incorporated herein by reference in their entireties.

TECHNICAL FIELD

The present disclosure relates to the field of display driving technology, in particular to a gate driving unit, a gate driving method, a gate driving circuitry and a display device.

BACKGROUND

In order to maintain pixel brightness fluctuation within a reasonable range, it is still necessary to refresh data when a static image is displayed, because a voltage for controlling brightness varies over time due to current leakage. As an effective method, a refresh rate is reduced so as to reduce the power consumption, and a current leakage rate of a pixel needs to be reduced so as to ensure the display quality. Oxide semiconductor has an ultra-low current leakage property, so it may be used to meet the above requirements. In order to ensure a charging rate of the pixel and provide a small parasitic capacitance, as a better approach, advantages of Low Temperature Poly-Silicon (LTPS) and oxide may be combined, i.e., a Low Temperature Polycrystalline Oxide (LTPO) process may be adopted. Usually, in a pixel circuitry, a Thin Film Transistor (TFT), which is sensitive to the current leakage occurring at a gate electrode of a driving transistor, is replaced with an oxide TFT, and the other transistors are LTPS TFTs, so as to make full use of their advantages to perform a gate driving operation at low power consumption. However, a normal-phase gate driving signal and a reverse-phase gate driving signal need to be adopted by the pixel circuitry, and it is inconvenient for a conventional gate driving circuitry to provide the normal-phase gate driving signal and the reverse-phase gate driving signal simultaneously, so a charging/discharging rate cannot be increased.

SUMMARY

In one aspect, the present disclosure provides a gate driving unit, including a reverse-phase gate driving signal output end, a normal-phase gate driving signal output end, an input circuitry, an output control circuitry, an input node control circuitry and an output circuitry. The input circuitry is connected to a first clock signal end, an input end and an input node, and configured to control the input end to be electrically connected to the input node under the control of a first clock signal from the first clock signal end. The output control circuitry is connected to the input node, a second clock signal end and an output node, and configured to control a potential at the output node under the control of a potential at the input node and a second clock signal from the second clock signal end. The input node control circuitry is connected to the second clock signal end, the output node and the input node, and configured to control the potential at the input node in accordance with the potential at the output node under the control of the second clock signal. The output circuitry is connected to the output node, the reverse-phase gate driving signal output end and the normal-phase gate driving signal output end, and configured to output a reverse-phase gate driving signal through the reverse-phase gate driving signal output end and output a normal-phase gate driving signal through the normal-phase gate driving signal output end in accordance with the potential at the output node.

In a possible embodiment of the present disclosure, the output control circuitry includes an NOR gate, a first input end of which is connected to the second clock signal end, a second input end of which is connected to the input node, and an output end of which is connected to the output node.

In a possible embodiment of the present disclosure, the output circuitry includes a first output phase inverter and a second output phase inverter. An input end of the first output phase inverter is connected to the output node, and an output end of the first output phase inverter is connected to the reverse-phase gate driving signal output end. An input end of the second output phase inverter is connected to the reverse-phase gate driving signal output end, and an output end of the second output phase inverter is connected to the normal-phase gate driving signal output end.

In a possible embodiment of the present disclosure, the input node control circuitry includes an input node control switching circuitry, a control end of which is connected to the second clock signal end, a first end of which is connected to the reverse-phase gate driving signal output end, and a second end of which is connected to the input node. The input node control switching circuitry is configured to enable the reverse-phase gate driving signal output end to be electrically connected to, or electrically disconnected from, the input node under the control of the second clock signal.

In a possible embodiment of the present disclosure, the NOR gate includes a first NOR transistor, a second NOR transistor, a third NOR transistor and a fourth NOR transistor, the first output phase inverter includes a first reverse-phase output transistor and a second reverse-phase output transistor, and the second output phase inverter includes a third reverse-phase output transistor and a fourth reverse-phase output transistor. The first NOR transistor, the second NOR transistor, the first reverse-phase output transistor and the third reverse-phase output transistor are p-type thin film transistors, and the third NOR transistor, the fourth NOR transistor, the second reverse-phase output transistor and the fourth reverse-phase output transistor are n-type thin film transistors.

In a possible embodiment of the present disclosure, a control electrode of the first NOR transistor is connected to the second clock signal end, a first electrode of the first NOR transistor is electrically connected to a first voltage end, and a second electrode of the first NOR transistor is connected to a first electrode of the second NOR transistor. A control electrode of the second NOR transistor is connected to the input node, and a second electrode of the second NOR transistor is connected to the output node. A control electrode of the third NOR transistor is connected to the input node, a first electrode of the third NOR transistor is connected to the output node, and a second electrode of the third NOR transistor is connected to a second voltage end. A control electrode of the fourth NOR transistor is connected to the second clock signal end, a first electrode of the fourth NOR transistor is connected to the output node, and a second electrode of the fourth NOR transistor is connected to the second voltage end.

In a possible embodiment of the present disclosure, a control electrode of the first reverse-phase output transistor is connected to the output node, a first electrode of the first reverse-phase output transistor is connected to the first voltage end, and a second electrode of the first reverse-phase output transistor is connected to the reverse-phase gate driving signal output end. A control electrode of the second reverse-phase output transistor is connected to the output node, a first electrode of the second reverse-phase output transistor is connected to the reverse-phase gate driving signal output end, and a second electrode of the second reverse-phase output transistor is connected to the second voltage end. A control electrode of the third reverse-phase output transistor is connected to the reverse-phase gate driving signal output end, a first electrode of the third reverse-phase output transistor is connected to the first voltage end, and a second electrode of the third reverse-phase output transistor is connected to the normal-phase gate driving signal output end. A control electrode of the fourth reverse-phase output transistor is connected to the reverse-phase gate driving signal output end, a first electrode of the fourth reverse-phase output transistor is connected to the normal-phase gate driving signal output end, and a second electrode of the fourth reverse-phase output transistor is connected to the second voltage end.

In a possible embodiment of the present disclosure, the input node control circuitry includes a control phase inverter and an input node control switching circuitry. An input end of the control phase inverter is connected to the output node. A control end of the input node control switching circuitry is connected to the second clock signal end, a first end of the input node control switching circuitry is connected to an output end of the control phase inverter, and a second end of the input node control switching circuitry is connected to the input node. The input node control switching circuitry is configured to enable the output end of the control phase inverter to be electrically connected to, or electrically disconnected from, the input node under the control of the second clock signal.

In a possible embodiment of the present disclosure, the output circuitry includes a first output phase inverter, a normal-phase output sub-circuitry and a reverse-phase output sub-circuitry. An input end of the first output phase inverter is connected to the output node, and an output end of the first output phase inverter is connected to a first node. The normal-phase output sub-circuitry is configured to output a normal-phase gate driving signal through the normal-phase gate driving signal output end in accordance with a potential at the first node. The reverse-phase output sub-circuitry is configured to output a reverse-phase gate driving signal through the reverse-phase gate driving signal output end in accordance with the potential at the first node.

In a possible embodiment of the present disclosure, the normal-phase output sub-circuitry includes a normal-phase output phase inverter, an input end of which is connected to the first node, and an output end of which is connected to the normal-phase gate driving signal output end. The reverse-phase output sub-circuitry includes a first reverse-phase output phase inverter and a second reverse-phase output phase inverter. An input end of the first reverse-phase output phase inverter is connected to the first node, an output end of the first reverse-phase output phase inverter is connected to an input end of the second reverse-phase output phase inverter, and an output end of the second reverse-phase output phase inverter is connected to the reverse-phase gate driving signal output end.

In a possible embodiment of the present disclosure, the NOR gate includes a first NOR transistor, a second NOR transistor, a third NOR transistor and a fourth NOR transistor, the first output phase inverter includes a first reverse-phase output transistor and a second reverse-phase output transistor, the normal-phase output phase inverter includes a first normal-phase output phase-inverting transistor and a second normal-phase output phase-inverting transistor, the first reverse-phase output phase inverter includes a first reverse-phase output phase-inverting transistor and a second reverse-phase output phase-inverting transistor, and the second reverse-phase output phase inverter includes a third reverse-phase output phase-inverting transistor and a fourth reverse-phase output phase-inverting transistor. The first NOR transistor, the second NOR transistor, the first reverse-phase output transistor, the first normal-phase output phase-inverting transistor, the first reverse-phase output phase-inverting transistor and the third reverse-phase output phase-inverting transistor are p-type thin film transistors, and the third NOR transistor, the fourth NOR transistor, the second reverse-phase output transistor, the second normal-phase output phase-inverting transistor, the second reverse-phase output phase-inverting transistor and the fourth reserve-phase output phase-inverting transistor are n-type thin film transistors.

In a possible embodiment of the present disclosure, a control electrode of the first NOR transistor is connected to the second clock signal end, a first electrode of the first NOR transistor is electrically connected to a first voltage end, and a second electrode of the first NOR transistor is connected to a first electrode of the second NOR transistor. A control electrode of the second NOR transistor is connected to the input node, and a second electrode of the second NOR transistor is connected to the output node. A control electrode of the third NOR transistor is connected to the input node, a first electrode of the third NOR transistor is connected to the output node, and a second electrode of the third NOR transistor is connected to a second voltage end. A control electrode of the fourth NOR transistor is connected to the second clock signal end, a first electrode of the fourth NOR transistor is connected to the output node, and a second electrode of the fourth NOR transistor is connected to the second voltage end.

In a possible embodiment of the present disclosure, a control electrode of the first reverse-phase output transistor is connected to the output node, a first electrode of the first reverse-phase output transistor is connected to the first voltage end, and a second electrode of the first reverse-phase output transistor is connected to the first node. A control electrode of the second reverse-phase output transistor is connected to the output node, a first electrode of the second reverse-phase output transistor is connected to the first node, and a second electrode of the second reverse-phase output transistor is connected to the second voltage end. A control electrode of the first normal-phase output phase-inverting transistor is connected to the first node, a first electrode of the first normal-phase output phase-inverting transistor is connected to the first voltage end, and a second electrode of the first normal-phase output phase-inverting transistor is connected to the reverse-phase gate driving signal output end. A control electrode of the second normal-phase output phase-inverting transistor is connected to the first node, a first electrode of the second normal-phase output phase-inverting transistor is connected to the reverse-phase gate driving signal output end, and a second electrode of the second normal-phase output phase-inverting transistor is connected to the second voltage end. A control electrode of the first reverse-phase output phase-inverting transistor is connected to the first node, a first electrode of the first reverse-phase output phase-inverting transistor is connected to the first voltage end, and a second electrode of the first reverse-phase output phase-inverting transistor is connected to a second node. A control electrode of the second reverse-phase output phase-inverting transistor is connected to the first node, a first electrode of the second reverse-phase output phase-inverting transistor is connected to the second node, and a second electrode of the second reverse-phase output phase-inverting transistor is connected to the second voltage end. A control electrode of the third reverse-phase output phase-inverting transistor is connected to the second node, a first electrode of the third reverse-phase output phase-inverting transistor is connected to the first voltage end, and a second electrode of the third reverse-phase output phase-inverting transistor is connected to the normal-phase gate driving signal output end. A control electrode of the fourth reverse-phase output phase-inverting transistor is connected to the second node, a first electrode of the fourth reverse-phase output phase-inverting transistor is connected to the normal-phase gate driving signal output end, and a second electrode of the fourth reverse-phase output phase-inverting transistor is connected to the second voltage end.

In a possible embodiment of the present disclosure, the input circuitry includes an input switching circuitry, a control end of which is connected to the first clock signal end, a first end of which is connected to the input end, and a second end of which is connected to the input node. The input switching circuitry is configured to enable the input end to be electrically connected to, or electrically disconnected from, the input node under the control the first clock signal from the first clock signal end.

In another aspect, the present disclosure further provides a gate driving method for the above-mentioned gate driving unit. A display period includes an input stage, an output stage and a resetting stage arranged sequentially. The gate driving method includes: at the input stage, controlling, by the input circuitry, the input end to be electrically connected to the input node under the control of the first clock signal, controlling, by the output control circuitry, a potential at the output node to be a first level under the control of a potential at the input node and the second clock signal, and controlling, by the output circuitry, the normal-phase gate driving signal output end to output the first level and controlling the reverse-phase gate driving signal output end to output a second level in accordance with the potential at the output node; at the output stage, controlling, by the input circuitry, the input end to be electrically connected to, or electrically disconnected from, the input node under the control of the first clock signal so as to maintain the potential at the input node as the first level, controlling, by the output control circuitry, the potential at the output node under the control of the potential at the input node and the second clock signal, controlling, by the input node control circuitry, the potential at the input node to be maintained as the first level in accordance with the potential at the output node under the control of the second clock signal, and controlling, by the output circuitry, the normal-phase gate driving signal output end to output the normal-phase gate driving signal and controlling the reverse-phase gate driving signal output end to output the reverse-phase gate driving signal in accordance with the potential at the output node; and at the resetting stage, controlling, by the input circuitry, the input end to be electrically connected to the input node under the control of the first clock signal, controlling, by the input node control circuitry, the output node to be electrically disconnected from the input node under the control of the second clock signal, controlling, by the output control circuitry, the potential at the output node to be the first level under the control of the potential at the input node and the second clock signal, and controlling, by the output circuitry, the normal-phase gate driving signal output end to output the first level and controlling the reverse-phase gate driving signal output end to output a second level in accordance with the potential at the output node.

In a possible embodiment of the present disclosure, at the output stage, the controlling, by the output control circuitry, the potential at the output node under the control of the potential at the input node and the second clock signal includes: when a potential of the second clock signal is the first level, controlling, by the output control circuitry, the potential at the output node to be the second level; and when the potential of the second clock signal is the second level, controlling, by the output control circuitry, the potential at the output node to be the first level. At the output stage, the controlling, by the output circuitry, the normal-phase gate driving signal output end to output the normal-phase gate driving signal and controlling the reverse-phase gate driving signal output end to output the reverse-phase gate driving signal in accordance with the potential at the output node includes: when the potential at the output node is the second level, controlling, by the output circuitry, the normal-phase gate driving signal output end to output the second level and controlling the reverse-phase gate driving signal output end to output the first level; and when the potential at the output node is the first level, controlling, by the output circuitry, the normal-phase gate driving signal output end to output the first level and controlling the reverse-phase gate driving signal output end to output the second level.

In a possible embodiment of the present disclosure, the display period further includes a maintenance stage after the resetting stage, and the maintenance stage includes at least one maintenance time period including a first maintenance sub-stage and a second maintenance sub-stage. The gate driving method further includes: at the first maintenance sub-stage, inputting the second level to the input end, enabling the first clock signal to be at the second level, enabling the second clock signal to be at the first level, controlling, by the input circuitry, the input end to be electrically disconnected from the input node under the control of the first clock signal, controlling, by the output control circuitry, the potential at the output node to be the first level under the control of the potential at the input node and the second clock signal, controlling, by the input node control circuitry, the potential at the input node to be maintained as the second level in accordance with the potential at the output node under the control of the second clock signal, and controlling, by the output circuitry, the normal-phase gate driving signal output end to output the first level and controlling the reverse-phase gate driving signal output end to output the second level in accordance with the potential at the output node; and at the second maintenance sub-stage, inputting the second level to the input end, enabling the first clock signal to be at the first level, enabling the second clock signal to be at the second level, controlling, by the input circuitry, the input end to be electrically connected to the input node under the control of the first clock signal, controlling, by the output control circuitry, the potential at the output node to be the first level under the control of the potential at the input node and the second clock signal, controlling, by the input node control circuitry, the output node to be electrically disconnected from the input node under the control of the second clock signal, and controlling, by the output circuitry, the normal-phase gate driving signal output end to output the first level and controlling the reverse-phase gate driving signal output end to output the second level in accordance with the potential at the output node.

In yet another aspect, the present disclosure provides a gate driving circuitry including a plurality of levels of the above-mentioned gate driving units. Apart from a first-level gate driving unit, an input end of a current-level gate driving unit is connected to a reverse-phase gate driving signal output end of a previous-level gate driving unit.

In a possible embodiment of the present disclosure, the gate driving circuitry further includes a first part of gate driving units and a second part of gate driving units arranged alternately. A first clock signal input end of each of the first part of gate driving units is connected to the first clock signal end, and a second clock signal input end of each of the first part of gate driving units is connected to the second clock signal end. A first clock signal input end of each of the second part of gate driving units is connected to the second clock signal end, and a second clock signal input end of each of the second part of gate driving units is connected to the first clock signal end.

In still yet another aspect, the present disclosure provides a display device including the above-mentioned gate driving circuitry.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Each transistor adopted in all the embodiments of the present disclosure may be a triode, a thin film transistor, a field-effect transistor, or any other element having a same characteristic. In the embodiments of the present disclosure, in order to differentiate two electrodes of the transistor, apart from a control electrode, from each other, one of the two electrodes may be called as a first electrode, and the other may be called as a second electrode.

In actual use, when the transistor is a triode, the control electrode may be a base, the first electrode may be a collector and the second electrode may be an emitter; or the control electrode may be a base, the first electrode may be an emitter and the second electrode may be a collector.

In actual use, when the transistor is a thin film transistor or a field-effect transistor, the control electrode may be a gate electrode, the first electrode may be a drain electrode and the second electrode may be a source electrode; or the control electrode may be a gate electrode, the first electrode may be a source electrode and the second electrode may be a drain electrode.

Figure 1A:
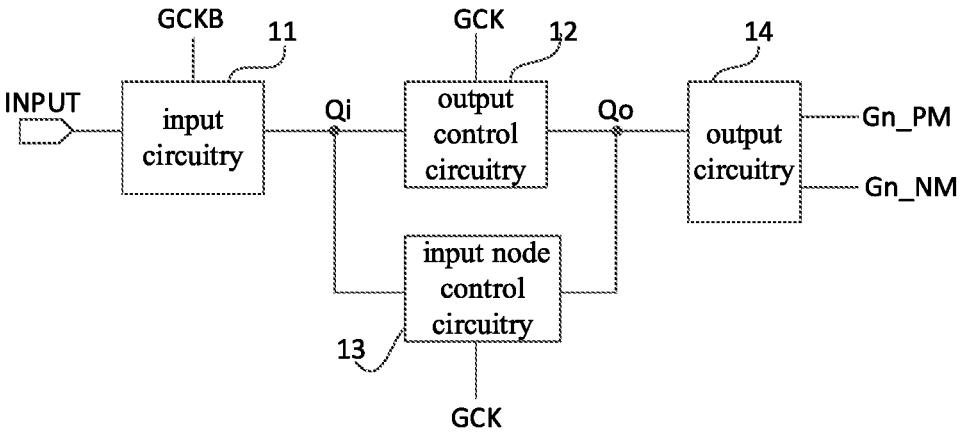
FIG. 1A is a schematic view showing a gate driving unit according to one embodiment of the present disclosure.

As shown in FIG. 1A, the present disclosure provides in some embodiments a gate driving unit, which includes a reverse-phase gate driving signal output end Gn_PM, a normal-phase gate driving signal output end Gn_NM, an input circuitry 11, an output control circuitry 12, an input node control circuitry 13 and an output circuitry 14. The input circuitry 11 is connected to a first clock signal end, an input end INPUT and an input node Qi, and configured to control the input end INPUT to be electrically connected to the input node Qi under the control of a first clock signal GCKB from the first clock signal end. The output control circuitry 12 is connected to the input node Qi, a second clock signal end and an output node Qo, and configured to control a potential at the output node Qo under the control of a potential at the input node Qi and a second clock signal GCK from the second clock signal end. The input node control circuitry 13 is connected to the second clock signal end, the output node Qo and the input node Qi, and configured to control the potential at the input node Qi in accordance with the potential at the output node Qo under the control of the second clock signal GCK. The output circuitry 14 is connected to the output node Qo, the reverse-phase gate driving signal output end Gn_PM and the normal-phase gate driving signal output end Gn_NM, and configured to output a reverse-phase gate driving signal through the reverse-phase gate driving signal output end Gn_PM and output a normal-phase gate driving signal through the normal-phase gate driving signal output end Gn_NM in accordance with the potential at the output node Qo.

According to the embodiments of the present disclosure, the gate driving unit may output the normal-phase gate driving signal and the reverse-phase gate driving signal simultaneously (at an output stage, the normal-phase gate driving signal may be of a phase reverse to the reverse-phase gate driving signal), so as to meet the requirement on driving pixels controlled by two gate driving signals, and increase a charging/discharging rate.

During the implementation, the first clock signal GCKB may be of, but not limited to, a phase reverse to the second clock signal GCK.

The gate driving unit in the embodiments of the present disclosure may be applied to a Complementary Metal Oxide Semiconductor (CMOS) pixel circuitry, particularly to a Low Temperature Polycrystalline Oxide (LTPO) pixel circuitry.

Figure 1B:
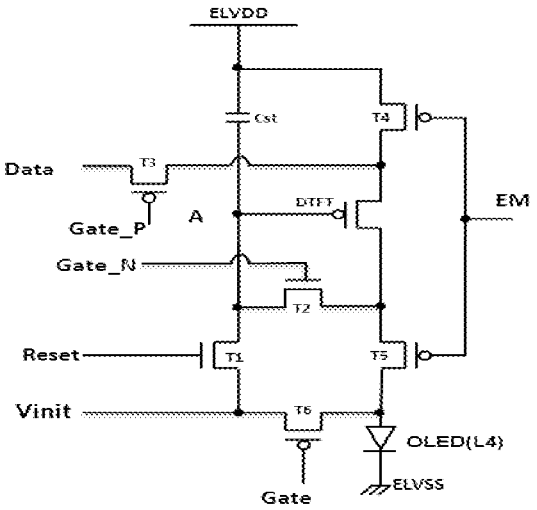
FIG. 1B is a circuit diagram of a pixel circuitry in which a normal-phase gate driving signal and a reverse-phase gate driving signal need to be used in the related art.

As shown in FIG. 1B, for a conventional pixel circuitry which needs to use a normal-phase gate driving signal and a reverse-phase gate driving signal, it includes a driving transistor DTFT, a first transistor T1, a second transistor T2, a third transistor T3, a fourth transistor T4, a fifth transistor T5, a sixth transistor T6, a storage capacitor Cst and an organic light-emitting diode OLED. In FIG. 1B, ELVDD represents a power source voltage, EM represents a light-emission control line, Data represents a data line, Gate_P represents an end for providing the reverse-phase gate driving signal, Gate_N represents an end for providing the normal-phase gate driving signal, Reset represents a resetting end, Vinit represents an initial voltage, ELVSS represents a low level, and Gate represents a gate line. However, in the related art, the pixel circuitry for providing the normal-phase gate driving signal is discharged slowly and the pixel circuitry for providing the reverse-phase gate driving signal is charged slowly, so a charging time of each pixel may be adversely affected.

To be specific, the output control circuitry may include an NOR gate, a first input end of which is connected to the second clock signal end, a second input end of which is connected to the input node, and an output end of which is connected to the output node.

When the output control circuitry includes the NOR gate and a potential of the second clock signal from the second clock signal end and/or the potential at the input node are each a high level, the NOR gate may output, via its output end, a low level to the output node. When the potential of the second clock signal from the second clock signal end and the potential at the input node are each a low level, the NOR gate may output, via its output end, a high level to the output node.

In a possible embodiment of the present disclosure, the output circuitry may include a first output phase inverter and a second output phase inverter. An input end of the first output phase inverter may be connected to the output node, and an output end of the first output phase inverter may be connected to the reverse-phase gate driving signal output end. An input end of the second output phase inverter may be connected to the reverse-phase gate driving signal output end, and an output end of the second output phase inverter may be connected to the normal-phase gate driving signal output end.

In a possible embodiment of the present disclosure, the input node control circuitry may include an input node control switching circuitry, a control end of which is connected to the second clock signal end, a first end of which is connected to the reverse-phase gate driving signal output end, and a second end of which is connected to the input node. The input node control switching circuitry is configured to enable the reverse-phase gate driving signal output end to be electrically connected to, or electrically disconnected from, the input node under the control of the second clock signal.

Figure 2:
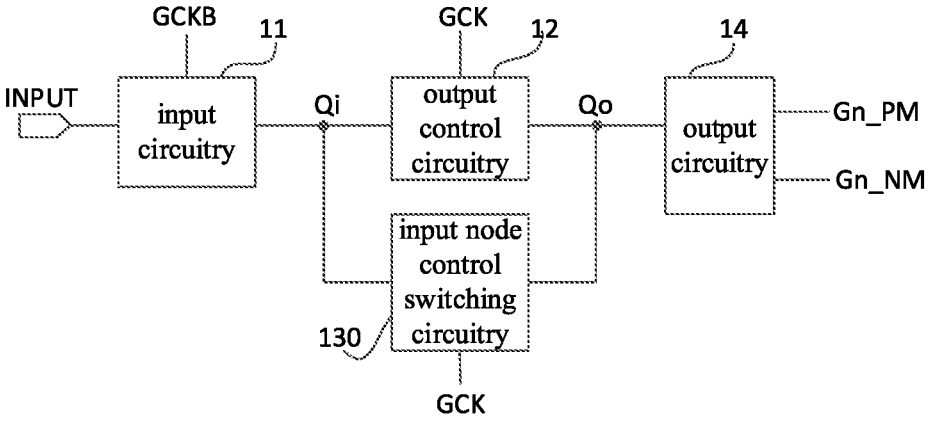
FIG. 2 is another schematic view showing the gate driving unit according to one embodiment of the present disclosure.

As shown in FIG. 2, on the basis of the gate driving unit in FIG. 1A, the input node control circuitry may include an input node control switching circuitry 130, a control end of which is connected to the second clock signal end for inputting the second clock signal GCK, a first end of which is connected to the reverse-phase gate driving signal output end Gn_PM, and a second end of which is connected to the input node Qi. The input node control switching circuitry 130 is configured to enable the reverse-phase gate driving signal output end Gn_PM to be electrically connected to, or electrically disconnected from, the input node Qi under the control of the second clock signal GCK.

During the operation of the gate driving unit in FIG. 2, the input node control switching circuitry 130 may control whether Gn_PM is electrically connected to Qi under the control of GCK.

In another possible embodiment of the present disclosure, the input node control circuitry may include a control phase inverter and an input node control switching circuitry. An input end of the control phase inverter may be connected to the output node. A control end of the input node control switching circuitry may be connected to the second clock signal end, a first end of the input node control switching circuitry may be connected to an output end of the control phase inverter, and a second end of the input node control switching circuitry may be connected to the input node. The input node control switching circuitry is configured to enable the output end of the control phase inverter to be electrically connected to, or electrically disconnected from, the input node under the control of the second clock signal.

Figure 3:
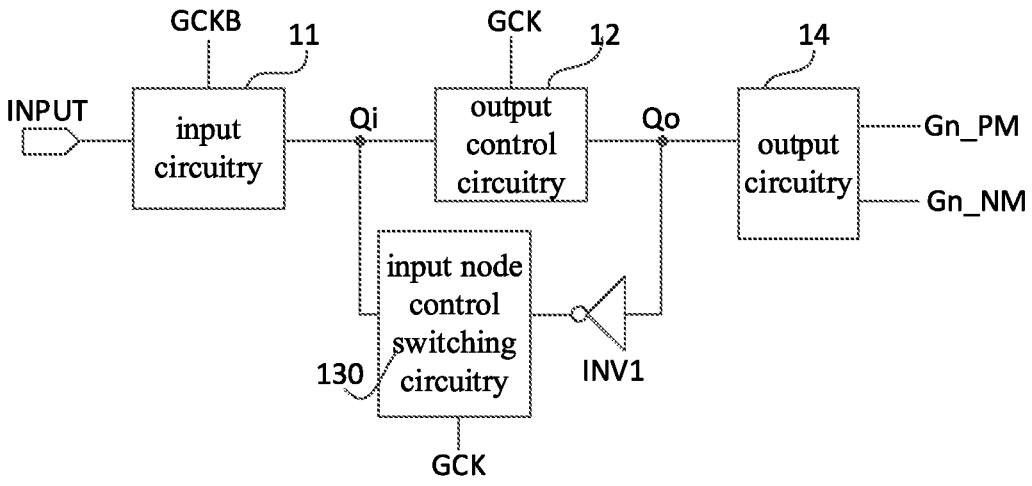
FIG. 3 is yet another schematic view showing the gate driving unit according to one embodiment of the present disclosure.

As shown in FIG. 3, on the basis of the gate driving unit in FIG. 1A, the input node control circuitry may include a control phase inverter INV1 and an input node control switching circuitry 130. An input end of the control phase inverter INV1 may be connected to the output node Qo. A control end of the input node control switching circuitry 130 may be connected to the second clock signal end, a first end of the input node control switching circuitry 130 may be connected to an output end of the control phase inverter INV1, and a second end of the input node control switching circuitry 130 may be connected to the input node Qi. The second clock signal end is configured to input a second clock signal GCK. The input node control switching circuitry 130 is configured to enable the output end of the control phase inverter INV1 to be electrically connected to, or electrically disconnected from, the input node Qi under the control of the second clock signal GCK.

During the operation of the gate driving unit in FIG. 3, a phase of the potential at Qo may be inverted by INV1, and the input node control switching circuitry 130 may control whether the output end of INV1 to be electrically connected to Qi under the control of the second clock signal GCK.

In another possible embodiment of the present disclosure, the output circuitry may include a first output phase inverter, a normal-phase output sub-circuitry and a reverse-phase output sub-circuitry. An input end of the first output phase inverter may be connected to the output node, and an output end of the first output phase inverter may be connected to a first node. The normal-phase output sub-circuitry is configured to output a normal-phase gate driving signal through the normal-phase gate driving signal output end in accordance with a potential at the first node. The reverse-phase output sub-circuitry is configured to output a reverse-phase gate driving signal through the reverse-phase gate driving signal output end in accordance with the potential at the first node.

To be specific, the normal-phase output sub-circuitry may include a normal-phase output phase inverter, an input end of which is connected to the first node, and an output end of which is connected to the normal-phase gate driving signal output end. The reverse-phase output sub-circuitry may include a first reverse-phase output phase inverter and a second reverse-phase output phase inverter. An input end of the first reverse-phase output phase inverter may be connected to the first node, an output end of the first reverse-phase output phase inverter may be connected to an input end of the second reverse-phase output phase inverter, and an output end of the second reverse-phase output phase inverter may be connected to the reverse-phase gate driving signal output end.

To be specific, the input circuitry may include an input switching circuitry, a control end of which is connected to the first clock signal end, a first end of which is connected to the input end, and a second end of which is connected to the input node.

Figure 4:
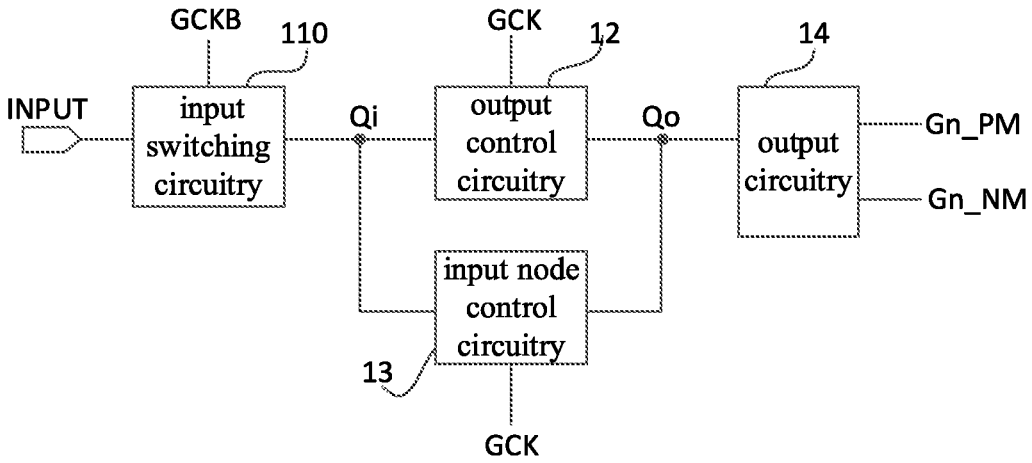
FIG. 4 is still yet another schematic view showing the gate driving unit according to one embodiment of the present disclosure.

As shown in FIG. 4, on the basis of the gate driving unit in FIG. 1A, the input circuitry may include an input switching circuitry 110, a control end of which is configured to receive a first clock signal GCKB, a first end of which is connected to the input end INPUT, and a second end of which is connected to the input node Qi. The input switching circuitry 110 is configured to control whether INPUT is electrically connected to Qi under the control of GCKB.

During the operation of the gate driving unit in FIG. 4, whether INPUT is electrically connected to Qi may be controlled under the control of GCKB.

The gate driving unit will be described hereinafter in conjunction with two specific embodiments.

Figure 5:
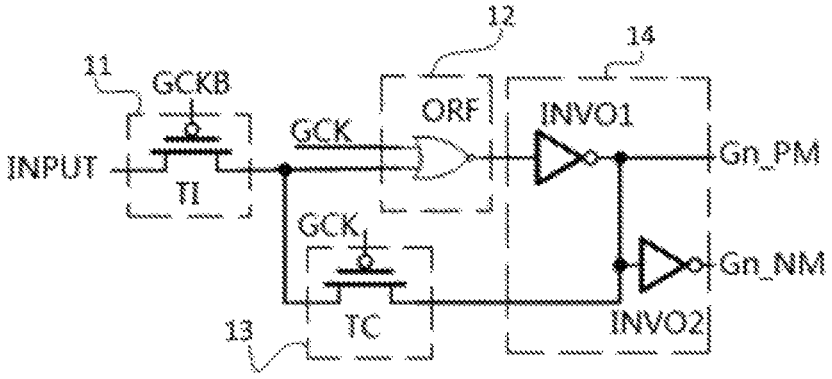
FIG. 5 is a circuit diagram of the gate driving unit according to a first embodiment of the present disclosure.

As shown in FIG. 5, in a first embodiment of the present disclosure, the gate driving unit may include the reverse-phase gate driving signal output end Gn_PM, the normal-phase gate driving signal output end Gn_NM, the input circuitry 11, the output control circuitry 12, the input node control circuitry 13 and the output circuitry 14. The input circuitry 11 may include an input switching circuitry which includes an input transistor TI. A gate electrode of the input transistor TI may receive the first clock signal GCKB, a source electrode thereof may be connected to the input end INPUT, and a drain electrode thereof may be connected to the input node Qi. The output control circuitry 12 may include an NOR gate ORF, a first input end of which is connected to the second clock signal end, a second input end of which is connected to the input node Qi, and an output end of which is connected to the output node Qo. The second clock signal end is configured to input the second clock signal GCK.

The input node control circuitry 13 may include an input node control switching circuitry which includes an input node control switching transistor TC. A gate electrode of the input node control switching transistor TC may receive the second clock signal GCK, a source electrode thereof may be connected to the input node Qi, and a drain electrode thereof may be connected to the reverse-phase gate driving signal output end Gn_PM.

The output circuitry 14 may include a first output phase inverter INVO1 and a second output phase inverter INVO2. An input end of the first output phase inverter INVO1 may be connected to the output node Qo, and an output end thereof may be connected to the reverse-phase gate driving signal output end Gn_PM. An input end of the second output phase inverter INVO2 may be connected to the reverse-phase gate driving signal output end Gn_PM, and an output end thereof may be connected to the normal-phase gate driving signal output end Gn_NM.

For the gate driving unit in the first embodiment as shown in FIG. 5, TI and TC may each be, but not limited to, a p-type thin film transistor.

Figure 6:
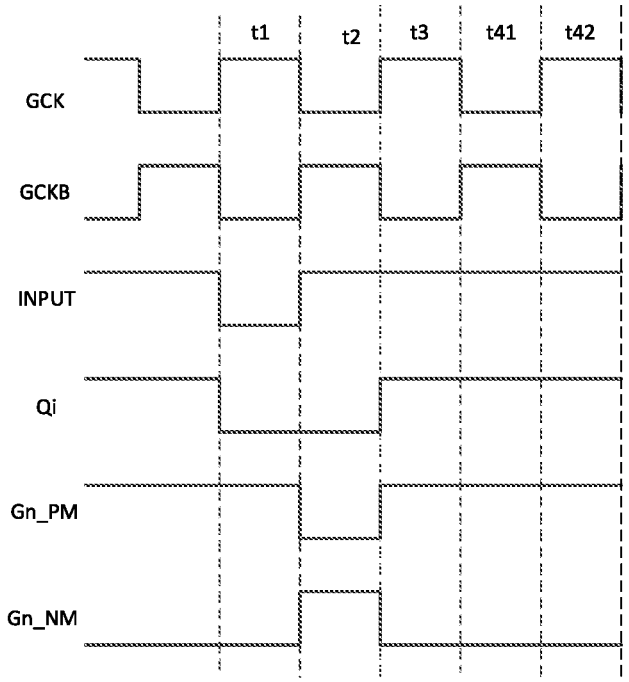
FIG. 6 is a sequence diagram of the gate driving unit according to first and second embodiments of the present disclosure.

FIG. 6 is a sequence diagram of the gate driving unit when a single-pulse gate driving signal is outputted according to the first embodiment of the present disclosure. As shown in FIG. 6, during the operation of the gate driving unit as shown in FIG. 5, a display period may include an input stage t1, an output stage t2, a resetting stage t3 and a maintenance stage arranged sequentially. The maintenance stage may include at least one maintenance time period which includes a first maintenance sub-stage and a second maintenance sub-stage. FIG. 6 merely shows one first maintenance sub-stage t41 and one second maintenance sub-stage t42.

At the input stage t1, INPUT may input a low level, GCK may be at a high level, and GCKB may be at a low level, so as to turn on TI and enable Qi to be electrically connected to INPUT, thereby to enable the potential at Qi to be a low level. ORF may output a low level, i.e., the potential at Qo may be a low level, so as to turn off TC. At this time, Gn_PM may output a high level, and Gn_NM may output a low level.

At the output stage t2, GCK may be at a low level, GCKB may be at a high level, and INPUT may input a high level, so as to turn off TI, thereby to maintain the potential at Qi as the low level and maintain the potential at Qo as the high level. At this time, Gn_PM may output a low level. TC may be turned on, so as to maintain the potential at Qi as the low level. At this time, Gn_NM may output a high level.

At the resetting stage t3, GCK may be at a high level, GCKB may be at a low level, and INPUT may input a high level, so as to turn on TI and enable Qi to be electrically connected to INPUT, thereby to pull up the potential at Qi to be a high level. ORF may output a low level, so as to pull down the potential at Qo to be a low level. At this time, Gn_PM may output a high level, and Gn_NM may output a low level.

At the first maintenance sub-stage t41, GCK may be at a low level, GCKB may be at a high level, and INPUT may input a high level, so as to turn off TI and maintain the potential at Qi as the high level. ORF may output a low level, so as to pull down the potential at Qo to be a low level. At this time, Gn_PM may output a high level, and Gn_NM may output a low level.

At the second maintenance sub-stage t42, GCK may be at a high level, GCKB may be at a low level, and INPUT may input a high level, so as to turn on TI and enable the potential at Qi to be a high level. ORF may output a low level, so as to pull down the potential at Qo to be a low level. At this time, Gn_PM may output a high level, and Gn_NM may output a low level.

At the maintenance stage, INPUT may be maintained at a high level.

The maintenance stage may include a plurality of maintenance time periods. At the first maintenance sub-stage and the second maintenance sub-stage of each of the plurality of maintenance time periods, the levels of GCK and GCKB may be switched periodically. For example, at a first maintenance sub-stage of a first maintenance time period, GCK may be a low level, and GCKB may be a high level, and at a second maintenance sub-stage of the first maintenance time period, GCK may be a high level, and GCKB may be a low level; at a first maintenance sub-stage of a second maintenance time period, GCK may be a low level, and GCKB may be a high level, and at a second maintenance sub-stage of the second maintenance time period, GCK may be a high level, and GCKB may be a low leve; . . . ; and at a first maintenance sub-stage of an $N^{th}$ maintenance time period, GCK may be a low level, and GCKB may be a high level, and at a second maintenance sub-stage of the $N^{th}$ maintenance time period, GCK may be a high level, and GCKB may be a low level, where N is an integer.

In addition, at the first maintenance sub-stage and the second maintenance sub-stage of each of the plurality of maintenance time periods, when the levels of GCK and GCKB are switched periodically, TI and TC may be turned on and off alternately, so as to maintain Qi at a high level. ORF may output a low level, so Gn_PM may output a high level, and Gn_NM may output a low level.

Figure 7:
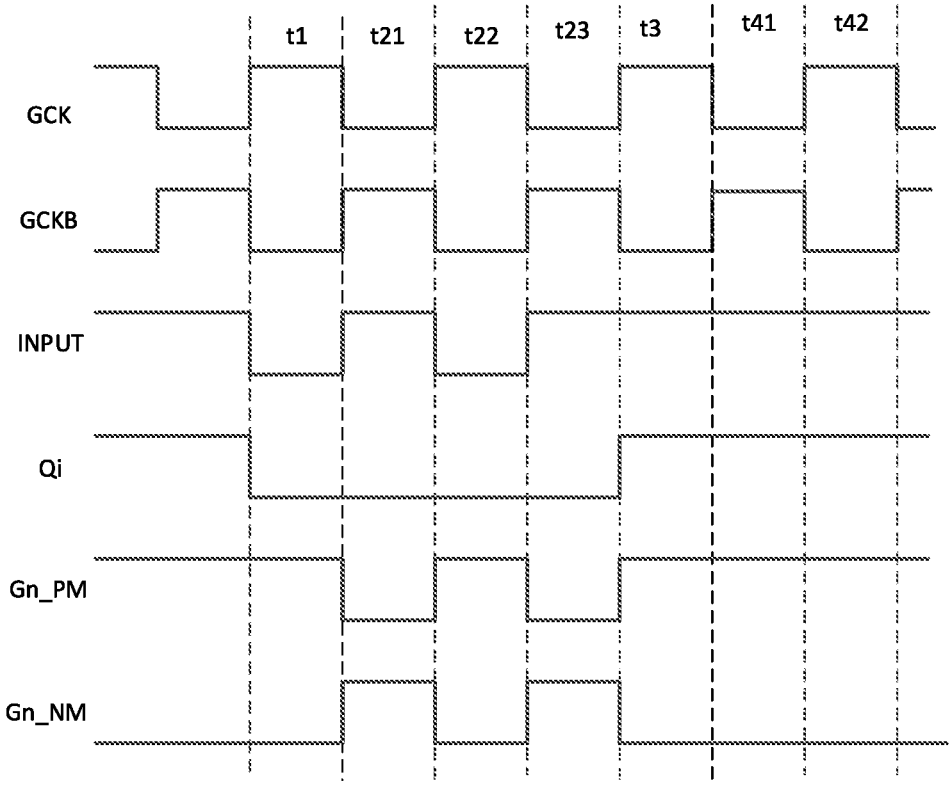
FIG. 7 is another sequence diagram of the gate driving unit according to the first and second embodiments of the present disclosure.

FIG. 7 is a sequence diagram of the gate driving unit when a multi-pulse gate driving signal is outputted according to the first embodiment of the present disclosure. As shown in FIG. 7, during the operation of the gate driving unit as shown in FIG. 5, a display period may include an input stage t1, an output stage t2, a resetting stage t3 and a maintenance stage arranged sequentially. The output stage may include a first output sub-stage t21, a second output sub-stage t22 and a third output sub-stage t23. The maintenance stage may include at least one maintenance time period which includes a first maintenance sub-stage and a second maintenance sub-stage. FIG. 7 merely shows one first maintenance sub-stage t41 and one second maintenance sub-stage t42.

At the input stage t1, INPUT may input a low level, GCK may be at a high level, and GCKB may be at a low level, so as to turn on TI and enable Qi to be electrically connected to INPUT, thereby to enable the potential at Qi to be a low level. ORF may output a low level, i.e., the potential at Qo may be a low level, so as to turn off TC. At this time, Gn_PM may output a high level, and Gn_NM may output a low level.

At the first output sub-stage t21, GCK may be at a low level, GCKB may be at a high level, and INPUT may input a high level, so as to turn off TI, thereby to maintain the potential at Qi as the low level and maintain the potential at Qo as the high level. At this time, Gn_PM may output a low level. TC may be turned on, so as to maintain the potential at Qi as the low level. At this time, Gn_NM may output a high level.

At the second output sub-stage t22, GCK may be at a high level, GCKB may be at a low level, and INPUT may input a low level, so as to turn on TI, and enable INPUT to be electrically connected to Qi, thereby to enable the potential at Qi to be a low level. ORF may output a low level, i.e., the potential at Qo may be a low level, so as to turn off TC. At this time, Gn_PM may output a high level, and Gn_NM may output a low level.

At the third output sub-stage t23, GCK may be at a low level, GCKB may be at a high level, and INPUT may input a high level, so as to turn off TI, and maintain the potential at Qi as the low level. ORF may output a high level, so as to turn on TC. At this time, Gn_PM may output a low level so as to maintain the potential at Qi as the low level, and Gn_NM may output a high level.

At the resetting stage t3, GCK may be at a high level, GCKB may be at a low level, and INPUT may input a high level, so as to turn on TI and enable the potential at Qi to be a high level. ORF may output a low level, so as to turn off TC. At this time, Gn_PM may output a high level, and Gn_NM may output a low level.

At the first maintenance sub-stage t41, GCK may be at a low level, GCKB may be at a high level, and INPUT may input a high level, so as to turn off TI and maintain the potential at Qi as the high level. ORF may output a low level, i.e., the potential at Qo may be a low level. At this time, Gn_PM may output a high level. TC may be turned on, so as to maintain the potential at Qi as the high level. At this time, Gn_NM may output a low level.

At the second maintenance sub-stage t42, GCK may be at a high level, GCKB may be at a low level, and INPUT may input a high level, so as to turn on TI, thereby to enable the potential at Qi to be a high level. ORF may output a low level, i.e., the potential at Qo may be a low level. At this time, Gn_PM may output a high level. TC may be turned off, and at this time, Gn_NM may output a low level.

Figure 8:
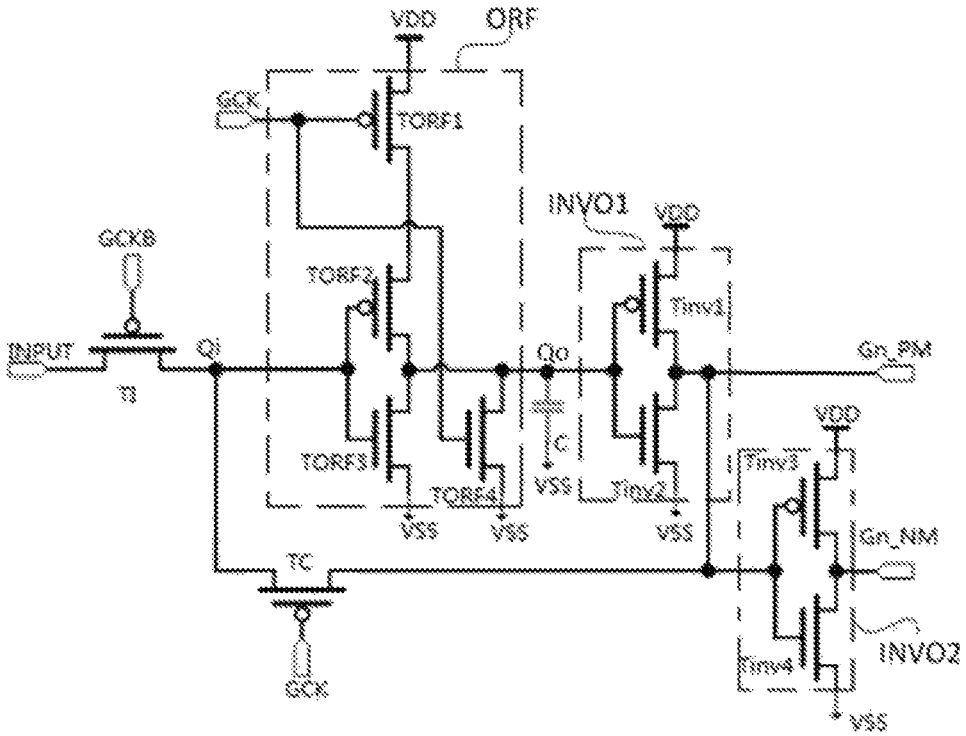
FIG. 8 is a transistor-level circuit diagram of the gate driving unit according to the first embodiment of the present disclosure.

FIG. 8 is a transistor-level circuit diagram of the gate driving unit as shown in FIG. 5 according to the first embodiment of the present disclosure. In FIG. 8, the NOR gate ORF may include a first NOR transistor TORF1, a second NOR transistor TORF2, a third NOR transistor TORF3 and a fourth NOR transistor TORF4. A control electrode of the first NOR transistor TORF1 may be connected to the second clock signal end, a first electrode of the first NOR transistor TORF1 may be electrically connected to a first voltage end, and a second electrode of the first NOR transistor TORF1 may be connected to a first electrode of the second NOR transistor TORF2. A control electrode of the second NOR transistor TORF2 may be connected to the input node Qi, and a second electrode of the second NOR transistor TORF2 may be connected to the output node Qo. A control electrode of the third NOR transistor TORF3 may be connected to the input node Qi, a first electrode of the third NOR transistor TORF3 may be connected to the output node Qo, and a second electrode of the third NOR transistor TORF3 may be connected to a second voltage end. A control electrode of the fourth NOR transistor TORF4 may be connected to the second clock signal end, a first electrode of the fourth NOR transistor TORF4 may be connected to the output node Qo, and a second electrode of the fourth NOR transistor TORF4 may be connected to the second voltage end. The first voltage end is configured to input a first voltage VDD, and the second voltage end is configured to input a second voltage VSS.

INVO1 may include a first reverse-phase output transistor Tinv1 and a second reverse-phase output transistor Tinv2. A control electrode of the first reverse-phase output transistor Tinv1 may be connected to the output node Qo, a first electrode of the first reverse-phase output transistor Tinv1 may be connected to the first voltage end, and a second electrode of the first reverse-phase output transistor Tinv1 may be connected to the reverse-phase gate driving signal output end Gn_PM. A control electrode of the second reverse-phase output transistor Tinv2 may be connected to the output node Qo, a first electrode of the second reverse-phase output transistor Tinv2 may be connected to the reverse-phase gate driving signal output end Gn_PM, and a second electrode of the second reverse-phase output transistor Tinv2 may be connected to the second voltage end.

INVO2 may include a third reverse-phase output transistor Tinv3 and a fourth reverse-phase output transistor Tinv4. A control electrode of the third reverse-phase output transistor Tinv3 may be connected to the reverse-phase gate driving signal output end Gn_PM, a first electrode of the third reverse-phase output transistor Tinv3 may be connected to the first voltage end, and a second electrode of the third reverse-phase output transistor Tinv3 may be connected to the normal-phase gate driving signal output end Gn_NM. A control electrode of the fourth reverse-phase output transistor Tinv4 may be connected to the reverse-phase gate driving signal output end Gn_PM, a first electrode of the fourth reverse-phase output transistor Tinv4 may be connected to the normal-phase gate driving signal output end Gn_NM, and a second electrode of the fourth reverse-phase output transistor Tinv4 may be connected to the second voltage end.

In FIG. 8, C represents a capacitor, VDD represents a high level, and VSS represents a low voltage. VSS may be, but not limited to, a ground voltage or a negative voltage.

In the circuit shown in FIG. 8, TI, TC, TORF1, TORF2, Tinv1 and Tinv3 may each be, but not limited to, a p-type thin film transistor, and TORF3, TORF4, Tinv2 and Tinv4 may each be, but not limited to, an n-type thin film transistor.

In actual use, the p-type transistor may be charged rapidly and the n-type transistor may be discharged rapidly. As shown in FIG. 8, Gn_PM may output the reverse-phase gate driving signal under the control of Tinv1 and Tinv2, and Gn_NM may output the normal-phase gate driving signal under the control of Tinv3 and Tinv4, so it is able to provide a high charging rate and a high discharging rate.

Figure 9:
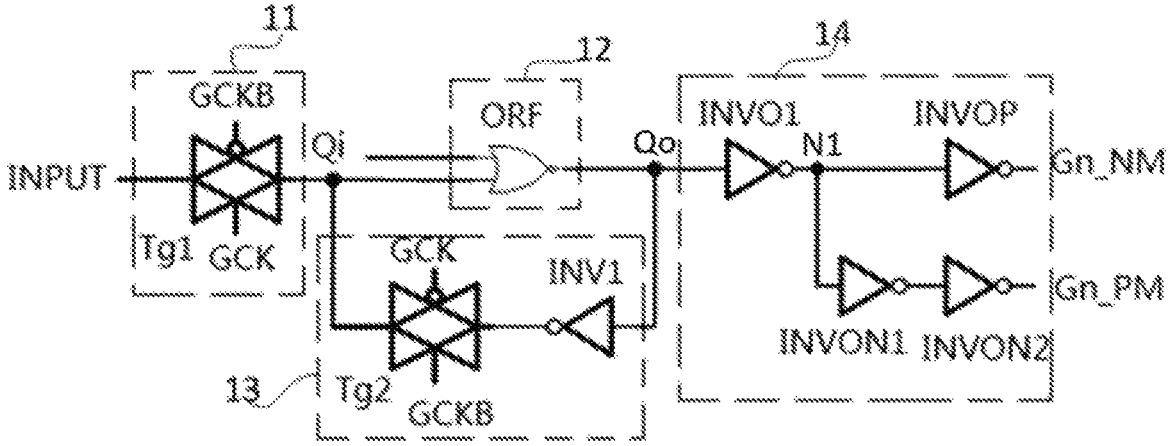
FIG. 9 is a circuit diagram of the gate driving unit according to the second embodiment of the present disclosure.

As shown in FIG. 9, in a second embodiment of the present disclosure, the gate driving unit may include the reverse-phase gate driving signal output end Gn_PM, the normal-phase gate driving signal output end Gn_NM, the input circuitry 11, the output control circuitry 12, the input node control circuitry 13 and the output circuitry 14. The input circuitry 11 may include an input switching circuitry which includes an input transmission gate Tg1. A reverse-phase control end of the input transmission gate Tg1 may receive the first clock signal GCKB, a normal-phase control end thereof may receive the second clock signal GCK, a first end thereof may be connected to the input end INPUT, and a second end thereof may be connected to the input node Qi. The output control circuitry 12 may include an NOR gate ORF, a first input end of which is connected to the second clock signal end, a second input end of which is connected to the input node Qi, and an output end of which is connected to the output node Qo. The second clock signal end is configured to input the second clock signal GCK.

The input node control circuitry 13 may include a control phase inverter INV1 and an input node control switching circuitry. An input end of the control phase inverter INV1 may be connected to the output node Qo. The input node control switching circuitry may include an input node control transmission gate Tg2, a reverse-phase control end of which receives the second clock signal GCKB, a normal-phase control end of which receives the first clock signal GCK, a first end of which is connected to an output end of the control phase inverter INV1, and a second end of which is connected to the input node Qi.

The output circuitry 14 may include a first output phase inverter INVO1, a normal-phase output sub-circuitry and a reverse-phase output sub-circuitry. An input end of the first output phase inverter INVO1 may be connected to the output node Qo, and an output end of the first output phase inverter INVO1 may be connected to a first node N1. The normal-phase output sub-circuitry may include a normal-phase output phase inverter INVOP, an input end of which is connected to the first node N1, and an output end of which is connected to the normal-phase gate driving signal output end Gn_NM. The reverse-phase output sub-circuitry may include a first reverse-phase output phase inverter INVON1 and a second reverse-phase output phase inverter INVON2. An input end of the first reverse-phase output phase inverter INVON1 may be connected to the first node N1, and an output end of the first reverse-phase output phase inverter INVON1 may be connected to an input end of the second reverse-phase output phase inverter INVON2, and an output end of the second reverse-phase output phase inverter INVON2 may be connected to the reverse-phase gate driving signal output end Gn_PM.

In the second embodiment of the present disclosure, the gate driving unit may include two reverse-phase output phase inverter for reverse-phase output, so as to increase the driving capability.

FIG. 6 is a sequence diagram of the gate driving unit when a single-pulse gate driving signal is outputted according to the second embodiment of the present disclosure. As shown in FIG. 6, during the operation of the gate driving unit as shown in FIG. 9, a display period may include an input stage t1, an output stage t2, a resetting stage t3 and a maintenance stage arranged sequentially. The maintenance stage may include at least one maintenance time period which includes a first maintenance sub-stage and a second maintenance sub-stage. FIG. 6 merely shows one first maintenance sub-stage t41 and one second maintenance sub-stage t42.

At the input stage t1, INPUT may input a low level, GCK may be at a high level, and GCKB may be at a low level, so as to enable Qi to be electrically connected to INPUT under the control of Tg1, thereby to enable the potential at Qi to be a low level. ORF may output a low level, i.e., the potential at Qo may be a low level, so as to turn off Tg2. At this time, Gn_PM may output a high level, and Gn_NM may output a low level.

At the output stage t2, GCK may be at a low level, GCKB may be at a high level, and INPUT may input a high level, so as to turn off Tg1, thereby to maintain the potential at Qi as the low level and maintain the potential at Qo as the high level. INV1 may output a low level, so as to enable the output end of INV1 to be electrically connected to Qi under the control of Tg2. At this time, Gn_PM may output a low level, and Gn_NM may output a high level.

At the resetting stage t3, GCK may be at a high level, GCKB may be at a low level, and INPUT may input a high level, so as to enable Qi to be electrically connected to INPUT under the control of Tg1, thereby to pull up the potential at Qi to be a high level. ORF may output a low level, so as to pull down the potential at Qo to be a low level, and turn off Tg2. At this time, Gn_PM may output a high level, and Gn_NM may output a low level.

At the first maintenance sub-stage t41, GCK may be at a low level, GCKB may be at a high level, and INPUT may input a high level, so as to turn off Tg1 and maintain the potential at Qi as the high level. ORF may output a low level, so as to pull down the potential at Qo to be a low level. INV1 may output a high level, so as to enable the output end of INV1 to be electrically connected to Qi under the control of Tg2. At this time, Gn_PM may output a high level, and Gn_NM may output a low level.

At the second maintenance sub-stage t42, GCK may be at a high level, GCKB may be at a low level, and INPUT may input a high level, so as to enable INPUT to be electrically connected to Qi under the control of Tg1, thereby to enable the potential at Qi to be a high level. ORF may output a low level, so as to pull down the potential at Qo to be a low level and turn off Tg2. At this time, Gn_PM may output a high level, and Gn_NM may output a low level.

At the maintenance stage, INPUT may be maintained at a high level. The maintenance stage may include a plurality of maintenance time periods. At the first maintenance sub-stage and the second maintenance sub-stage of each of the plurality of maintenance time periods, the levels of GCK and GCKB may be switched periodically, and Tg1 and Tg2 may be turned on and off alternately, so as to maintain Qi at a high level. ORF may output a low level, so Gn_PM may output a high level, and Gn_NM may output a low level.

FIG. 7 is a sequence diagram of the gate driving unit when a multi-pulse gate driving signal is outputted according to the second embodiment of the present disclosure. As shown in FIG. 7, during the operation of the gate driving unit as shown in FIG. 9, a display period may include an input stage t1, an output stage t2, a resetting stage t3 and a maintenance stage arranged sequentially. The output stage may include a first output sub-stage t21, a second output sub-stage t22 and a third output sub-stage t23. The maintenance stage may include at least one maintenance time period which includes a first maintenance sub-stage and a second maintenance sub-stage. FIG. 7 merely shows one first maintenance sub-stage t41 and one second maintenance sub-stage t42.

At the input stage t1, INPUT may input a low level, GCK may be at a high level, and GCKB may be at a low level, so as to enable Qi to be electrically connected to INPUT under the control of Tg1, thereby to enable the potential at Qi to be a low level. ORF may output a low level, i.e., the potential at Qo may be a low level, so as to turn off Tg2. At this time, Gn_PM may output a high level, and Gn_NM may output a low level.

At the first output sub-stage t21, GCK may be at a low level, GCKB may be at a high level, and INPUT may input a high level, so as to turn off Tg1, maintain the potential at Qo as the high level, and enable the output end of INV1 to be electrically connected to Qi under the control of Tg2. INV1 may output a low level, so as to maintain the potential at Qi as the low level. At this time, Gn_PM may output a low level, and Gn_NM may output a high level.

At the second output sub-stage t22, GCK may be at a high level, GCKB may be at a low level, and INPUT may input a low level, so as to enable INPUT to be electrically connected to Qi under the control of Tg1, thereby to enable the potential at Qi to be a low level. ORF may output a low level, i.e., the potential at Qo may be a low level, so as to turn off Tg2. At this time, Gn_PM may output a high level, and Gn_NM may output a low level.

At the third output sub-stage t23, GCK may be at a low level, GCKB may be at a high level, and INPUT may input a high level, so as to turn off Tg1. ORF may output a high level, i.e., the potential at Qo may be a high level, so as to enable the output end of INV1 to be electrically connected to Qi under the control of Tg2. INV1 may output a low level, so as to maintain the potential at Qi as the low level. At this time, Gn_PM may output a low level, and Gn_NM may output a high level.

At the resetting stage t3, GCK may be at a high level, GCKB may be at a low level, and INPUT may input a high level, so as to enable INPUT to be electrically connected to Qi under the control of Tg1, thereby to enable the potential at Qi to be a high level. ORF may output a low level, i.e., the potential at Qo may be a low level, so as to turn off Tg2. At this time, Gn_PM may output a high level, and Gn_NM may output a low level.

At the first maintenance sub-stage t41, GCK may be at a low level, GCKB may be at a high level, and INPUT may input a high level, so as to turn off Tg1 and maintain the potential at Qi as the high level. ORF may output a low level, i.e., the potential at Qo may be a low level. INV1 may output a high level, so as to enable INV1 to be electrically connected to Qi under the control of Tg2. At this time, Gn_PM may output a high level, and Gn_NM may output a low level.

At the second maintenance sub-stage t42, GCK may be at a high level, GCKB may be at a low level, and INPUT may input a high level, so as to enable INPUT to be electrically connected to Qi under the control of Tg1, thereby to enable the potential at Qi to be a high level. ORF may output a low level, i.e., the potential at Qo may be a low level. At this time, Gn_PM may output a high level, and Gn_NM may output a low level.

Figure 10:
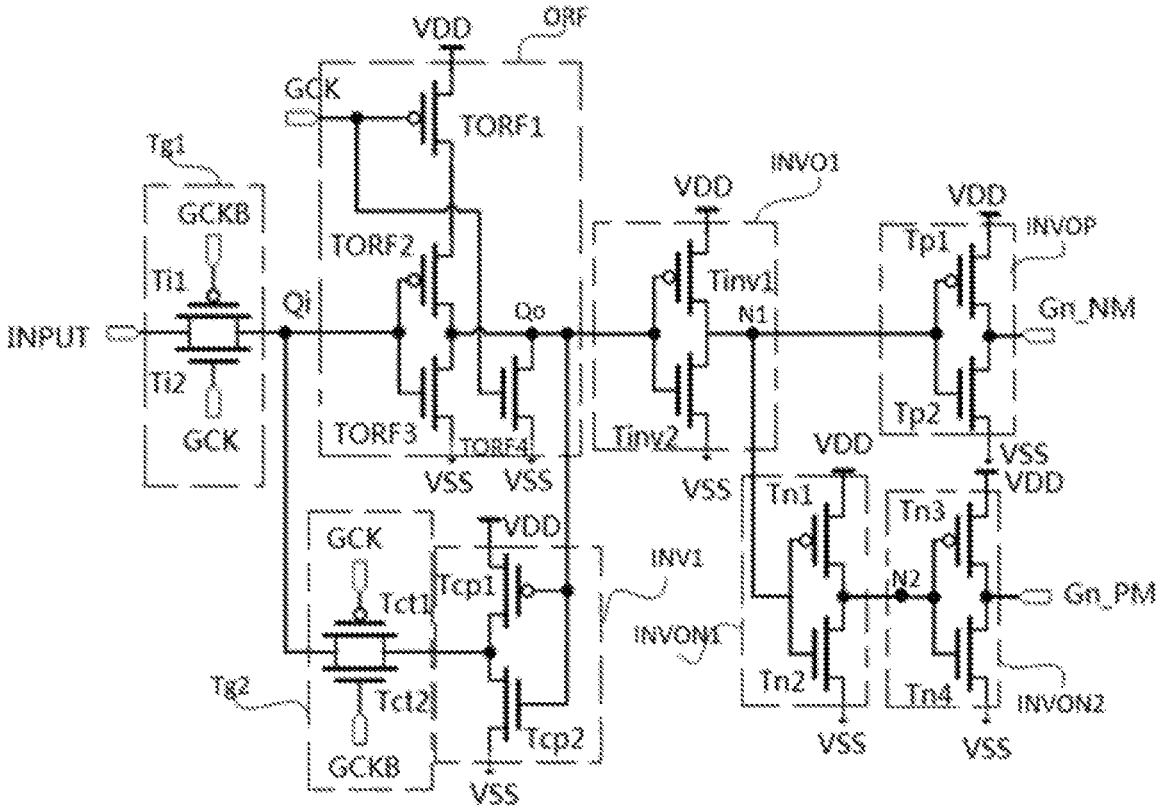
FIG. 10 is a transistor-level circuit diagram of the gate driving unit according to the second embodiment of the present disclosure.

FIG. 10 is a transistor-level circuit diagram of the gate driving unit as shown in FIG. 9 according to the second embodiment of the present disclosure. In FIG. 10, the input transmission gate Tg1 may include a first input transmission transistor Ti1 and a second input transmission transistor Ti2.

The NOR gate ORF may include a first NOR transistor TORF1, a second NOR transistor TORF2, a third NOR transistor TORF3 and a fourth NOR transistor TORF4. A control electrode of the first NOR transistor TORF1 may be connected to the second clock signal end, a first electrode of the first NOR transistor TORF1 may be electrically connected to a first voltage end, and a second electrode of the first NOR transistor TORF1 may be connected to a first electrode of the second NOR transistor TORF2. A control electrode of the second NOR transistor TORF2 may be connected to the input node Qi, and a second electrode of the second NOR transistor TORF2 may be connected to the output node Qo. A control electrode of the third NOR transistor TORF3 may be connected to the input node Qi, a first electrode of the third NOR transistor TORF3 may be connected to the output node Qo, and a second electrode of the third NOR transistor TORF3 may be connected to a second voltage end. A control electrode of the fourth NOR transistor TORF4 may be connected to the second clock signal end, a first electrode of the fourth NOR transistor TORF4 may be connected to the output node Qo, and a second electrode of the fourth NOR transistor TORF4 may be connected to the second voltage end. The first voltage end is configured to input a first voltage VDD, and the second voltage end is configured to input a second voltage VSS.

The control phase inverter INV1 may include a first control phase inverting transistor Tcp1 and a second control phase inverting transistor Tcp2. A control electrode of the first control phase inverting transistor Tcp1 may be connected to the output node Qo, a first electrode thereof may be connected to the first voltage end, and a second electrode thereof may be connected to a first end of the input node control transmission gate Tg2. A control electrode of the second control phase inverting transistor Tcp2 may be connected to the output node Qo, a first electrode thereof maybe connected to the first end of the input node control transmission gate Tg2, and a second electrode thereof may be connected to the second voltage end.

The input node control transmission gate Tg2 may include a first control transmission transistor Tct1 and a second control transmission transistor Tct2.

The first output phase inverter INVO1 may include a first reverse-phase output transistor Tinv1 and a second reverse-phase output transistor Tinv2. A control electrode of the first reverse-phase output transistor Tinv1 may be connected to the output node Qo, a first electrode of the first reverse-phase output transistor Tinv1 may be connected to the first voltage end, and a second electrode of the first reverse-phase output transistor Tinv1 may be connected to the first node N1. A control electrode of the second reverse-phase output transistor Tinv2 may be connected to the output node Qo, a first electrode of the second reverse-phase output transistor Tinv2 may be connected to the first node N1, and a second electrode of the second reverse-phase output transistor Tinv2 may be connected to the second voltage end.

The normal-phase output phase inverter INVOP may include a first normal-phase output phase inverting transistor Tp1 and a second normal-phase output phase inverting transistor Tp2. A control electrode of the first normal-phase output phase inverting transistor Tp1 may be connected to the first node N1, a first electrode thereof may be connected to the first voltage end, and a second electrode thereof may be connected to the reverse-phase gate driving signal output end Gn_PM. A control electrode of the second normal-phase output phase inverting transistor Tp2 may be connected to the first node N1, a first electrode thereof may be connected to the reverse-phase gate driving signal output end Gn_PM, and a second electrode thereof may be connected to the second voltage end.

The first reverse-phase output phase inverter INVON1 may include a first reverse-phase output phase inverting transistor Tn1 and a second reverse-phase output phase inverting transistor Tn2. A control electrode of the first reverse-phase output phase inverting transistor Tn1 may be connected to the first node N1, a first electrode thereof may be connected to the first voltage end, and a second electrode thereof may be connected to the second node N2. A control electrode of the second reverse-phase output phase inverting transistor Tn2 may be connected to the first node N1, a first electrode thereof may be connected to the second node N2, and a second electrode thereof may be connected to the second voltage end.

The second reverse-phase output phase inverter INVON2 may include a third reverse-phase output phase inverting transistor Tn3 and a fourth reverse-phase output phase inverting transistor Tn4. A control electrode of the third reverse-phase output phase inverting transistor Tn3 may be connected to the second node N2, a first electrode thereof may be connected to the first voltage end, and a second electrode thereof may be connected to the normal-phase gate driving signal output end Gn_NM. A control electrode of the fourth reverse-phase output phase inverting transistor Tn4 may be connected to the second node N2, a first electrode thereof may be connected to the normal-phase gate driving signal output end Gn_NM, and a second electrode thereof may be connected to the second voltage end.

In FIG. 10, VDD represents a high level, and VSS represents a low voltage. VSS may be, but not limited to, a ground voltage or a negative voltage.

In the circuit in FIG. 10, Ti1, TORF1, TORF2, Tinv1, Tp1, Tct1, Tcp1, Tn1 and Tn3 may each be, but not limited to, a p-type thin film transistor, and Ti2, TORF3, TORF4, Tinv2, Tp2, Tct2, Tcp2, Tn2 and Tn4 may each be, but not limited to, an n-type thin film transistor.

In actual use, the p-type transistor may be charged rapidly and the n-type transistor may be discharged rapidly. As shown in FIG. 10, Gn_NM may output the reverse-phase gate driving signal under the control of Tp1 and Tp2, and Gn_PM may output the normal-phase gate driving signal under the control of Tn1, Tn2, Tn3 and Tn4, so it is able to provide a high charging rate and a high discharging rate.

The present disclosure further provides in some embodiments a gate driving method for the above-mentioned gate driving unit. A display period includes an input stage, an output stage and a resetting stage arranged sequentially. The gate driving method includes: at the input stage, controlling, by the input circuitry, the input end to be electrically connected to the input node under the control of the first clock signal, controlling, by the output control circuitry, a potential at the output node to be a first level under the control of a potential at the input node and the second clock signal, and controlling, by the output circuitry, the normal-phase gate driving signal output end to output the first level and controlling the reverse-phase gate driving signal output end to output a second level in accordance with the potential at the output node; at the output stage, controlling, by the input circuitry, the input end to be electrically connected to, or electrically disconnected from, the input node under the control of the first clock signal so as to maintain the potential at the input node as the first level, controlling, by the output control circuitry, the potential at the output node under the control of the potential at the input node and the second clock signal, controlling, by the input node control circuitry, the potential at the input node to be maintained as the first level in accordance with the potential at the output node under the control of the second clock signal, and controlling, by the output circuitry, the normal-phase gate driving signal output end to output the normal-phase gate driving signal and controlling the reverse-phase gate driving signal output end to output the reverse-phase gate driving signal in accordance with the potential at the output node; and at the resetting stage, controlling, by the input circuitry, the input end to be electrically connected to the input node under the control of the first clock signal, controlling, by the input node control circuitry, the output node to be electrically disconnected from the input node under the control of the second clock signal, controlling, by the output control circuitry, the potential at the output node to be the first level under the control of the potential at the input node and the second clock signal, and controlling, by the output circuitry, the normal-phase gate driving signal output end to output the first level and controlling the reverse-phase gate driving signal output end to output the second level in accordance with the potential at the output node.

In the embodiments of the present disclosure, the first level may be, but not limited to, a low level, and the second level may be, but not limited to, a high level.

During the implementation, the first level may also be, but not limited to, a high level, and the second level may also be, but not limited to, a low level.

To be specific, at the output stage, the controlling, by the output control circuitry, the potential at the output node under the control of the potential at the input node and the second clock signal may include: when a potential of the second clock signal is the first level, controlling, by the output control circuitry, the potential at the output node to be the second level; and when the potential of the second clock signal is the second level, controlling, by the output control circuitry, the potential at the output node to be the first level. At the output stage, the controlling, by the output circuitry, the normal-phase gate driving signal output end to output the normal-phase gate driving signal and controlling the reverse-phase gate driving signal output end to output the reverse-phase gate driving signal in accordance with the potential at the output node may include: when the potential at the output node is the second level, controlling, by the output circuitry, the normal-phase gate driving signal output end to output the second level and controlling the reverse-phase gate driving signal output end to output the first level; and when the potential at the output node is the first level, controlling, by the output circuitry, the normal-phase gate driving signal output end to output the first level and controlling the reverse-phase gate driving signal output end to output the second level.

During the implementation, the display period may further include a maintenance stage after the resetting stage, and the maintenance stage may include at least one maintenance time period including a first maintenance sub-stage and a second maintenance sub-stage. The gate driving method may further include: at the first maintenance sub-stage, inputting the second level to the input end, enabling the first clock signal to be at the second level, enabling the second clock signal to be at the first level, controlling, by the input circuitry, the input end to be electrically disconnected from the input node under the control of the first clock signal, controlling, by the output control circuitry, the potential at the output node to be the first level under the control of the potential at the input node and the second clock signal, controlling, by the input node control circuitry, the potential at the input node to be maintained as the second level in accordance with the potential at the output node under the control of the second clock signal, and controlling, by the output circuitry, the normal-phase gate driving signal output end to output the first level and controlling the reverse-phase gate driving signal output end to output the second level in accordance with the potential at the output node; and at the second maintenance sub-stage, inputting the second level to the input end, enabling the first clock signal to be at the first level, enabling the second clock signal to be at the second level, controlling, by the input circuitry, the input end to be electrically connected to the input node under the control of the first clock signal, controlling, by the output control circuitry, the potential at the output node to be the first level under the control of the potential at the input node and the second clock signal, controlling, by the input node control circuitry, the output node to be electrically disconnected from the input node under the control of the second clock signal, and controlling, by the output circuitry, the normal-phase gate driving signal output end to output the first level and controlling the reverse-phase gate driving signal output end to output the second level in accordance with the potential at the output node.

The present disclosure further provides in some embodiments a gate driving circuitry including a plurality of levels of the above-mentioned gate driving units. Apart from a first-level gate driving unit, an input end of a current-level gate driving unit is connected to a reverse-phase gate driving signal output end of a previous-level gate driving unit.

In some embodiments of the present disclosure, the gate driving circuitry may further include a first part of gate driving units and a second part of gate driving units arranged alternately. A first clock signal input end of each of the first part of gate driving units may be connected to the first clock signal end, and a second clock signal input end of each of the first part of gate driving units may be connected to the second clock signal end. A first clock signal input end of each of the second part of gate driving units may be connected to the second clock signal end, and a second clock signal input end of each of the second part of gate driving units may be connected to the first clock signal end.

The first part of gate driving units may be odd-numbered gate driving units in the plurality of levels of gate driving units, and the second part of gate driving units may be even-numbered gate driving units in the plurality of levels of gate driving units. For example, as shown in FIG. 11, the first part of gate driving units may include S1, S3, . . . , S(2N+1), and the second part of gate driving units may include S2, S4, . . . , S(2N), where N is an integer.

Figure 11:
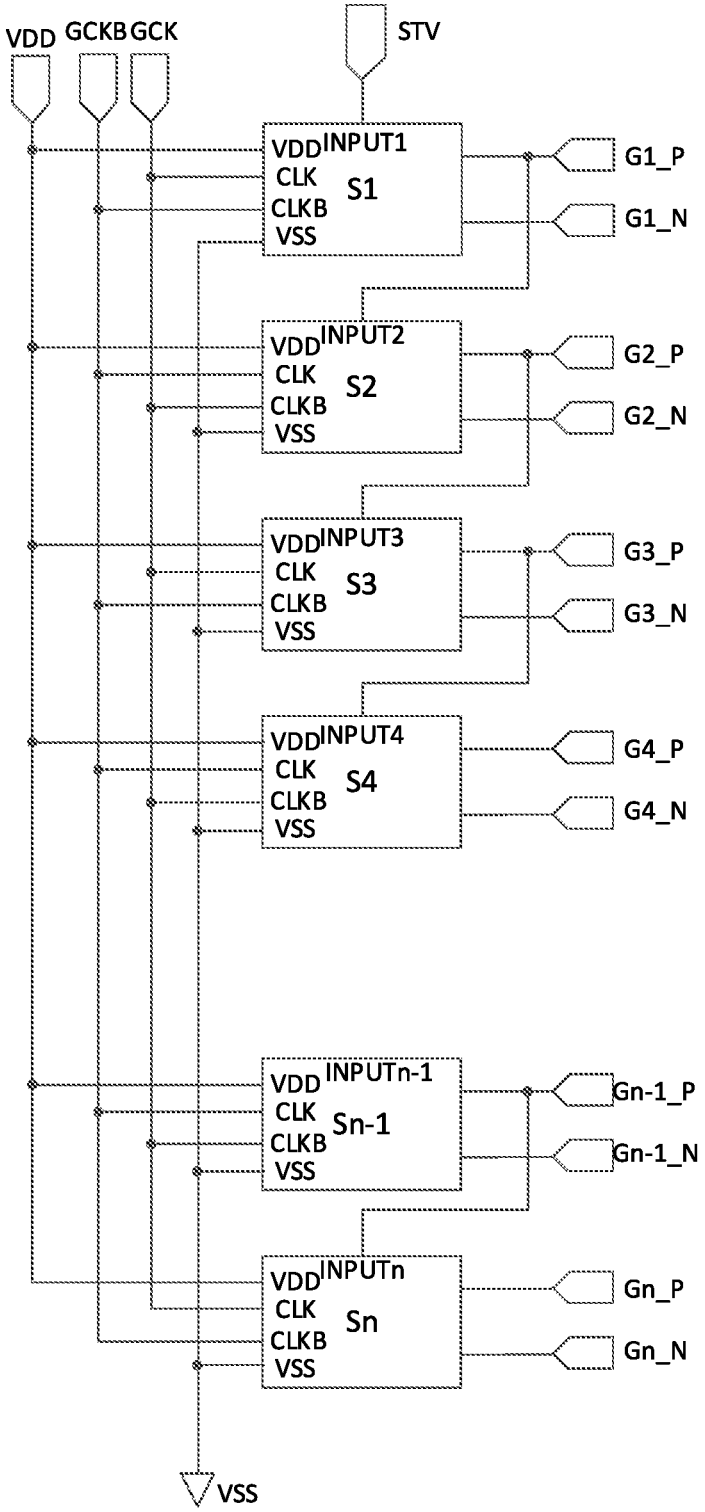
FIG. 11 is a schematic view showing a gate driving circuitry according to one embodiment of the present disclosure.

As shown in FIG. 11, a first clock signal input end CLKB of S1 is connected to the first clock signal end (corresponding to the first clock signal GCKB), and a second clock signal input end CLK of S1 is connected to the second clock signal end (corresponding to the second clock signal GCK); a first clock signal input end CLKB of S2 is connected to the second clock signal end (corresponding to the second clock signal GCK), and a second clock signal input end CLK of S2 is connected to the first clock signal end (corresponding to the first clock signal GCKB); and so on. In other words, in the plurality of levels of gate driving units in FIG. 11, CLK and CLKB of the odd-numbered-level and even-numbered-level gate driving units are connected to GCK and GCKB alternately.

In FIG. 11, S1 represents a first-level gate driving unit of the gate driving circuitry, S2 represents a second-level gate driving unit of the gate driving circuitry, S3 represents a third-level gate driving unit of the gate driving circuitry, S4 represents a fourth-level gate driving unit of the gate driving circuitry, Sn-1 represents an $(n-1)^{th}$-level gate driving unit of the gate driving circuitry, and Sn represents an $n^{th}$-level gate driving unit of the gate driving circuitry, where n is an integer greater than 5.

In FIG. 11, CLKB represents the first clock signal input end, CLK represents the second clock signal input end, VDD represents a high voltage, VSS represents a low voltage, G1_P represents a first-level normal-phase gate driving signal output end, G1_N represents a first-level reverse-phase gate driving signal output end, G2_P represents a second-level normal-phase gate driving signal output end, G2_N represents a second-level reverse-phase gate driving signal output end, G3_P represents a third-level normal-phase gate driving signal output end, G3_N represents a third-level reverse-phase gate driving signal output end, G4_P represents a fourth-level normal-phase gate driving signal output end, G4_N represents a fourth-level reverse-phase gate driving signal output end, Gn-1_P represents an $(n-1)^{th}$-level normal-phase gate driving signal output end, Gn-1_N represents an $(n-1)^{th}$-level reverse-phase gate driving signal output end, Gn_P represents an $n^{th}$-level normal-phase gate driving signal output end, Gn_N represents an $n^{th}$-level reverse-phase gate driving signal output end, INPUT1 represents a first-level input end for receiving a start signal STV, INPUT2 represents a second-level input end, INPUT3 represents a third-level input end, INPUT4 represents a fourth-level input end, INPUTn-1 represents an $(n-1)^{th}$-level input and, and INPUTn represents an $n^{th}$-level input end.

As shown in FIG. 11, INPUT2 may be connected to G1_P, INPUT3 may be connected to G2_P, INPUT4 may be connected to G3_P, and INPUTn may be connected to Gn-1_P.

The present disclosure further provides in some embodiments a display device including the above-mentioned gate driving circuitry.

The display device in the embodiments of the present disclosure may be any product or member having a display function, e.g., mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate driving unit, comprising a reverse-phase gate driving signal output end, a normal-phase gate driving signal output end, an input circuitry, an output control circuitry, an input node control circuitry and an output circuitry, wherein the input circuitry is connected to a first clock signal end, an input end and an input node, and configured to control the input end to be electrically connected to the input node under the control of a first clock signal from the first clock signal end;

the output control circuitry is connected to the input node, a second clock signal end and an output node, and configured to control a potential at the output node under the control of a potential at the input node and a second clock signal from the second clock signal end;

the input node control circuitry is connected to the second clock signal end, the output node and the input node, and configured to control the potential at the input node in accordance with the potential at the output node under the control of the second clock signal; and the output circuitry is connected to the output node, the reverse-phase gate driving signal output end and the normal-phase gate driving signal output end, and configured to output a reverse-phase gate driving signal through the reverse-phase gate driving signal output end and output a normal-phase gate driving signal through the normal-phase gate driving signal output end in accordance with the potential at the output node;

wherein the output control circuitry comprises an NOR gate, a first input end of which is connected to the second clock signal end, a second input end of which is connected to the input node, and an output end of which is connected to the output node.

2. The gate driving unit according to claim 1, wherein the output circuitry comprises a first output phase inverter and a second output phase inverter; an input end of the first output phase inverter is connected to the output node, and an output end of the first output phase inverter is connected to the reverse-phase gate driving signal output end; and an input end of the second output phase inverter is connected to the reverse-phase gate driving signal output end, and an output end of the second output phase inverter is connected to the normal-phase gate driving signal output end.

3. The gate driving unit according to claim 2, wherein the input node control circuitry comprises an input node control switching circuitry, a control end of which is connected to the second clock signal end, a first end of which is connected to the reverse-phase gate driving signal output end, and a second end of which is connected to the input node; and the input node control switching circuitry is configured to enable the reverse-phase gate driving signal output end to be electrically connected to, or electrically disconnected from, the input node under the control of the second clock signal.

4. The gate driving unit according to claim 2, wherein the NOR gate comprises a first NOR transistor, a second NOR transistor, a third NOR transistor and a fourth NOR transistor, the first output phase inverter comprises a first reverse-phase output transistor and a second reverse-phase output transistor, and the second output phase inverter comprises a third reverse-phase output transistor and a fourth reverse-phase output transistor; and the first NOR transistor, the second NOR transistor, the first reverse-phase output transistor and the third reverse-phase output transistor are p-type thin film transistors, and the third NOR transistor, the fourth NOR transistor, the second reverse-phase output transistor and the fourth reverse-phase output transistor are n-type thin film transistors.

5. The gate driving unit according to claim 4, wherein a control electrode of the first NOR transistor is connected to the second clock signal end, a first electrode of the first NOR transistor is electrically connected to a first voltage end, and a second electrode of the first NOR transistor is connected to a first electrode of the second NOR transistor; a control electrode of the second NOR transistor is connected to the input node, and a second electrode of the second NOR transistor is connected to the output node; a control electrode of the third NOR transistor is connected to the input node, a first electrode of the third NOR transistor is connected to the output node, and a second electrode of the third NOR transistor is connected to a second voltage end; and a control electrode of the fourth NOR transistor is connected to the second clock signal end, a first electrode of the fourth NOR transistor is connected to the output node, and a second electrode of the fourth NOR transistor is connected to the second voltage end.

6. The gate driving unit according to claim 4, wherein a control electrode of the first reverse-phase output transistor is connected to the output node, a first electrode of the first reverse-phase output transistor is connected to the first voltage end, and a second electrode of the first reverse-phase output transistor is connected to the reverse-phase gate driving signal output end; a control electrode of the second reverse-phase output transistor is connected to the output node, a first electrode of the second reverse-phase output transistor is connected to the reverse-phase gate driving signal output end, and a second electrode of the second reverse-phase output transistor is connected to the second voltage end; a control electrode of the third reverse-phase output transistor is connected to the reverse-phase gate driving signal output end, a first electrode of the third reverse-phase output transistor is connected to the first voltage end, and a second electrode of the third reverse-phase output transistor is connected to the normal-phase gate driving signal output end; and a control electrode of the fourth reverse-phase output transistor is connected to the reverse-phase gate driving signal output end, a first electrode of the fourth reverse-phase output transistor is connected to the normal-phase gate driving signal output end, and a second electrode of the fourth reverse-phase output transistor is connected to the second voltage end.

7. A gate driving unit, comprising a reverse-phase gate driving signal output end, a normal-phase gate driving signal output end, an input circuitry, an output control circuitry, an input node control circuitry and an output circuitry, wherein the input circuitry is connected to a first clock signal end, an input end and an input node, and configured to control the input end to be electrically connected to the input node under the control of a first clock signal from the first clock signal end;

the output control circuitry is connected to the input node, a second clock signal end and an output node, and configured to control a potential at the output node under the control of a potential at the input node and a second clock signal from the second clock signal end;

the input node control circuitry is connected to the second clock signal end, the output node and the input node, and configured to control the potential at the input node in accordance with the potential at the output node under the control of the second clock signal; and the output circuitry is connected to the output node, the reverse-phase gate driving signal output end and the normal-phase gate driving signal output end, and configured to output a reverse-phase gate driving signal through the reverse-phase gate driving signal output end and output a normal-phase gate driving signal through the normal-phase gate driving signal output end in accordance with the potential at the output node;

wherein the input node control circuitry comprises a control phase inverter and an input node control switching circuitry; an input end of the control phase inverter is connected to the output node; a control end of the input node control switching circuitry is connected to the second clock signal end, a first end of the input node control switching circuitry is connected to an output end of the control phase inverter, and a second end of the input node control switching circuitry is connected to the input node; and the input node control switching circuitry is configured to enable the output end of the control phase inverter to be electrically connected to, or electrically disconnected from, the input node under the control of the second clock signal.

8. The gate driving unit according to claim 1, wherein the output circuitry comprises a first output phase inverter, a normal-phase output sub-circuitry and a reverse-phase output sub-circuitry; an input end of the first output phase inverter is connected to the output node, and an output end of the first output phase inverter is connected to a first node; the normal-phase output sub-circuitry is configured to output a normal-phase gate driving signal through the normal-phase gate driving signal output end in accordance with a potential at the first node; and the reverse-phase output sub-circuitry is configured to output a reverse-phase gate driving signal through the reverse-phase gate driving signal output end in accordance with the potential at the first node.

9. The gate driving unit according to claim 8, wherein the normal-phase output sub-circuitry comprises a normal-phase output phase inverter, an input end of which is connected to the first node, and an output end of which is connected to the normal-phase gate driving signal output end; the reverse-phase output sub-circuitry comprises a first reverse-phase output phase inverter and a second reverse-phase output phase inverter; and an input end of the first reverse-phase output phase inverter is connected to the first node, an output end of the first reverse-phase output phase inverter is connected to an input end of the second reverse-phase output phase inverter, and an output end of the second reverse-phase output phase inverter is connected to the reverse-phase gate driving signal output end.

10. The gate driving unit according to claim 8, wherein the NOR gate comprises a first NOR transistor, a second NOR transistor, a third NOR transistor and a fourth NOR transistor, the first output phase inverter comprises a first reverse-phase output transistor and a second reverse-phase output transistor, the normal-phase output phase inverter comprises a first normal-phase output phase-inverting transistor and a second normal-phase output phase-inverting transistor, the first reverse-phase output phase inverter comprises a first reverse-phase output phase-inverting transistor and a second reverse-phase output phase-inverting transistor, and the second reverse-phase output phase inverter comprises a third reverse-phase output phase-inverting transistor and a fourth reverse-phase output phase-inverting transistor; and the first NOR transistor, the second NOR transistor, the first reverse-phase output transistor, the first normal-phase output phase-inverting transistor, the first reverse-phase output phase-inverting transistor and the third reverse-phase output phase-inverting transistor are p-type thin film transistors, and the third NOR transistor, the fourth NOR transistor, the second reverse-phase output transistor, the second normal-phase output phase-inverting transistor, the second reverse-phase output phase-inverting transistor and the fourth reserve-phase output phase-inverting transistor are n-type thin film transistors.

11. The gate driving unit according to claim 10, wherein a control electrode of the first NOR transistor is connected to the second clock signal end, a first electrode of the first NOR transistor is electrically connected to a first voltage end, and a second electrode of the first NOR transistor is connected to a first electrode of the second NOR transistor; a control electrode of the second NOR transistor is connected to the input node, and a second electrode of the second NOR transistor is connected to the output node; a control electrode of the third NOR transistor is connected to the input node, a first electrode of the third NOR transistor is connected to the output node, and a second electrode of the third NOR transistor is connected to a second voltage end; and a control electrode of the fourth NOR transistor is connected to the second clock signal end, a first electrode of the fourth NOR transistor is connected to the output node, and a second electrode of the fourth NOR transistor is connected to the second voltage end.

12. The gate driving unit according to claim 11, wherein a control electrode of the first reverse-phase output transistor is connected to the output node, a first electrode of the first reverse-phase output transistor is connected to the first voltage end, and a second electrode of the first reverse-phase output transistor is connected to the first node; a control electrode of the second reverse-phase output transistor is connected to the output node, a first electrode of the second reverse-phase output transistor is connected to the first node, and a second electrode of the second reverse-phase output transistor is connected to the second voltage end; a control electrode of the first normal-phase output phase-inverting transistor is connected to the first node, a first electrode of the first normal-phase output phase-inverting transistor is connected to the first voltage end, and a second electrode of the first normal-phase output phase-inverting transistor is connected to the reverse-phase gate driving signal output end; a control electrode of the second normal-phase output phase-inverting transistor is connected to the first node, a first electrode of the second normal-phase output phase-inverting transistor is connected to the reverse-phase gate driving signal output end, and a second electrode of the second normal-phase output phase-inverting transistor is connected to the second voltage end; a control electrode of the first reverse-phase output phase-inverting transistor is connected to the first node, a first electrode of the first reverse-phase output phase-inverting transistor is connected to the first voltage end, and a second electrode of the first reverse-phase output phase-inverting transistor is connected to a second node; a control electrode of the second reverse-phase output phase-inverting transistor is connected to the first node, a first electrode of the second reverse-phase output phase-inverting transistor is connected to the second node, and a second electrode of the second reverse-phase output phase-inverting transistor is connected to the second voltage end; a control electrode of the third reverse-phase output phase-inverting transistor is connected to the second node, a first electrode of the third reverse-phase output phase-inverting transistor is connected to the first voltage end, and a second electrode of the third reverse-phase output phase-inverting transistor is connected to the normal-phase gate driving signal output end; and a control electrode of the fourth reverse-phase output phase-inverting transistor is connected to the second node, a first electrode of the fourth reverse-phase output phase-inverting transistor is connected to the normal-phase gate driving signal output end, and a second electrode of the fourth reverse-phase output phase-inverting transistor is connected to the second voltage end.

13. The gate driving unit according to claim 1, wherein the input circuitry comprises an input switching circuitry, a control end of which is connected to the first clock signal end, a first end of which is connected to the input end, and a second end of which is connected to the input node, wherein the input switching circuitry is configured to enable the input end to be electrically connected to, or electrically disconnected from, the input node under the control the first clock signal from the first clock signal end.

14. A gate driving method for the gate driving unit according to claim 1, wherein a display period comprises an input stage, an output stage and a resetting stage arranged sequentially, wherein the gate driving method comprises:

at the input stage, controlling, by the input circuitry, the input end to be electrically connected to the input node under the control of the first clock signal, controlling, by the output control circuitry, a potential at the output node to be a first level under the control of a potential at the input node and the second clock signal, and controlling, by the output circuitry, the normal-phase gate driving signal output end to output the first level and controlling the reverse-phase gate driving signal output end to output a second level in accordance with the potential at the output node;

at the output stage, controlling, by the input circuitry, the input end to be electrically connected to, or electrically disconnected from, the input node under the control of the first clock signal so as to maintain the potential at the input node as the first level, controlling, by the output control circuitry, the potential at the output node under the control of the potential at the input node and the second clock signal, controlling, by the input node control circuitry, the potential at the input node to be maintained as the first level in accordance with the potential at the output node under the control of the second clock signal, and controlling, by the output circuitry, the normal-phase gate driving signal output end to output the normal-phase gate driving signal and controlling the reverse-phase gate driving signal output end to output the reverse-phase gate driving signal in accordance with the potential at the output node; and at the resetting stage, controlling, by the input circuitry, the input end to be electrically connected to the input node under the control of the first clock signal, controlling, by the input node control circuitry, the output node to be electrically disconnected from the input node under the control of the second clock signal, controlling, by the output control circuitry, the potential at the output node to be the first level under the control of the potential at the input node and the second clock signal, and controlling, by the output circuitry, the normal-phase gate driving signal output end to output the first level and controlling the reverse-phase gate driving signal output end to output the second level in accordance with the potential at the output node.

15. The gate driving method according to claim 14, wherein at the output stage, the controlling, by the output control circuitry, the potential at the output node under the control of the potential at the input node and the second clock signal comprises: when a potential of the second clock signal is the first level, controlling, by the output control circuitry, the potential at the output node to be the second level; and when the potential of the second clock signal is the second level, controlling, by the output control circuitry, the potential at the output node to be the first level, wherein at the output stage, the controlling, by the output circuitry, the normal-phase gate driving signal output end to output the normal-phase gate driving signal and controlling the reverse-phase gate driving signal output end to output the reverse-phase gate driving signal in accordance with the potential at the output node comprises: when the potential at the output node is the second level, controlling, by the output circuitry, the normal-phase gate driving signal output end to output the second level and controlling the reverse-phase gate driving signal output end to output the first level; and when the potential at the output node is the first level, controlling, by the output circuitry, the normal-phase gate driving signal output end to output the first level and controlling the reverse-phase gate driving signal output end to output the second level.

16. The gate driving method according to claim 14, wherein the display period further comprises a maintenance stage after the resetting stage, and the maintenance stage comprises at least one maintenance time period comprising a first maintenance sub-stage and a second maintenance sub-stage, wherein the gate driving method further comprises:

at the first maintenance sub-stage, inputting the second level to the input end, enabling the first clock signal to be at the second level, enabling the second clock signal to be at the first level, controlling, by the input circuitry, the input end to be electrically disconnected from the input node under the control of the first clock signal, controlling, by the output control circuitry, the potential at the output node to be the first level under the control of the potential at the input node and the second clock signal, controlling, by the input node control circuitry, the potential at the input node to be maintained as the second level in accordance with the potential at the output node under the control of the second clock signal, and controlling, by the output circuitry, the normal-phase gate driving signal output end to output the first level and controlling the reverse-phase gate driving signal output end to output the second level in accordance with the potential at the output node; and at the second maintenance sub-stage, inputting the second level to the input end, enabling the first clock signal to be at the first level, enabling the second clock signal to be at the second level, controlling, by the input circuitry, the input end to be electrically connected to the input node under the control of the first clock signal, controlling, by the output control circuitry, the potential at the output node to be the first level under the control of the potential at the input node and the second clock signal, controlling, by the input node control circuitry, the output node to be electrically disconnected from the input node under the control of the second clock signal, and controlling, by the output circuitry, the normal-phase gate driving signal output end to output the first level and controlling the reverse-phase gate driving signal output end to output the second level in accordance with the potential at the output node.

17. A gate driving circuitry, comprising a plurality of levels of the gate driving units according to claim 1, wherein apart from a first-level gate driving unit, an input end of a current-level gate driving unit is connected to a reverse-phase gate driving signal output end of a previous-level gate driving unit.

18. The gate driving circuitry according to claim 17, further comprising a first part of gate driving units and a second part of gate driving units arranged alternately, wherein a first clock signal input end of each of the first part of gate driving units is connected to the first clock signal end, and a second clock signal input end of each of the first part of gate driving units is connected to the second clock signal end; and a first clock signal input end of each of the second part of gate driving units is connected to the second clock signal end, and a second clock signal input end of each of the second part of gate driving units is connected to the first clock signal end.

19. A display device, comprising the gate driving circuitry according to claim 17.

20. A gate driving method for a gate driving unit, wherein the gate driving unit comprises a reverse-phase gate driving signal output end, a normal-phase gate driving signal output end, an input circuitry, an output control circuitry, an input node control circuitry and an output circuitry, wherein the input circuitry is connected to a first clock signal end, an input end and an input node, and configured to control the input end to be electrically connected to the input node under the control of a first clock signal from the first clock signal end;

the output control circuitry is connected to the input node, a second clock signal end and an output node, and configured to control a potential at the output node under the control of a potential at the input node and a second clock signal from the second clock signal end;

the input node control circuitry is connected to the second clock signal end, the output node and the input node, and configured to control the potential at the input node in accordance with the potential at the output node under the control of the second clock signal; and the output circuitry is connected to the output node, the reverse-phase gate driving signal output end and the normal-phase gate driving signal output end, and configured to output a reverse-phase gate driving signal through the reverse-phase gate driving signal output end and output a normal-phase gate driving signal through the normal-phase gate driving signal output end in accordance with the potential at the output node;

wherein a display period comprises an input stage, an output stage and a resetting stage arranged sequentially, wherein the gate driving method comprises:

at the input stage, controlling, by the input circuitry, the input end to be electrically connected to the input node under the control of the first clock signal, controlling, by the output control circuitry, a potential at the output node to be a first level under the control of a potential at the input node and the second clock signal, and controlling, by the output circuitry, the normal-phase gate driving signal output end to output the first level and controlling the reverse-phase gate driving signal output end to output a second level in accordance with the potential at the output node;

at the output stage, controlling, by the input circuitry, the input end to be electrically connected to, or electrically disconnected from, the input node under the control of the first clock signal so as to maintain the potential at the input node as the first level, controlling, by the output control circuitry, the potential at the output node under the control of the potential at the input node and the second clock signal, controlling, by the input node control circuitry, the potential at the input node to be maintained as the first level in accordance with the potential at the output node under the control of the second clock signal, and controlling, by the output circuitry, the normal-phase gate driving signal output end to output the normal-phase gate driving signal and controlling the reverse-phase gate driving signal output end to output the reverse-phase gate driving signal in accordance with the potential at the output node; and at the resetting stage, controlling, by the input circuitry, the input end to be electrically connected to the input node under the control of the first clock signal, controlling, by the input node control circuitry, the output node to be electrically disconnected from the input node under the control of the second clock signal, controlling, by the output control circuitry, the potential at the output node to be the first level under the control of the potential at the input node and the second clock signal, and controlling, by the output circuitry, the normal-phase gate driving signal output end to output the first level and controlling the reverse-phase gate driving signal output end to output the second level in accordance with the potential at the output node.

* * * * *